US006670757B2

(12) United States Patent
Kato et al.

(10) Patent No.: US 6,670,757 B2
(45) **Date of Patent: *Dec. 30, 2003**

(54) PLASMA DISPLAY PANEL, METHOD OF MANUFACTURING THE SAME, AND DISPLAY DEVICE USING THE SAME

(75) Inventors: Tetsuya Kato, Sagamihara (JP); Yoshio Watanabe, Yokohama (JP); Hiroki Kono, Kawasaki (JP)

(73) Assignee: Matsushita Electric Industrial Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/358,861

(22) Filed: Jul. 22, 1999

(65) Prior Publication Data

US 2002/0195936 A1 Dec. 26, 2002

(30) Foreign Application Priority Data

Oct. 20, 1998 (JP) ..... 10-298243
Oct. 29, 1998 (JP) ..... 10-308184
Oct. 29, 1998 (JP) ..... 10-308186
Jul. 22, 1999 (JP) ..... 10-206005

(51) Int. Cl.[7] ..... H01J 17/49
(52) U.S. Cl. ..... 313/587; 313/582; 313/586
(58) Field of Search ..... 313/582, 583, 313/584, 585, 586, 587, 580, 292; 445/24

(56) References Cited

U.S. PATENT DOCUMENTS 3,589,789 A 6/1971 Hubert et al.
4,692,662 A 9/1987 Wada et al.
5,736,815 A * 4/1998 Amemiya ..... 313/586
5,939,828 A * 8/1999 Matsuzaki et al. ..... 313/584
6,043,604 A * 3/2000 Horiuchi et al. ..... 313/582
6,232,716 B1 * 5/2001 Ok et al. ..... 313/582
6,236,160 B1 * 5/2001 Komaki et al. ..... 313/586
6,353,288 B1 * 3/2002 Asano et al. ..... 313/582
2002/0008472 A1 * 1/2002 Ha ..... 313/582

FOREIGN PATENT DOCUMENTS

| | | |
|---|---|---|
| EP | 0 284 138 | 3/1988 |
| EP | 0 284 138 A2 | 9/1988 |
| EP | 0 823 722 A2 | 2/1998 |
| EP | 0 939 421 A2 | 9/1999 |
| FR | 2 762 426 | 4/1998 |
| FR | 2 762 426 | 10/1998 |
| JP | 02223132 | 9/1990 |

(List continued on next page.)

*Primary Examiner*—Nimeshkumar D. Patel
*Assistant Examiner*—Karabi Guharay
(74) *Attorney, Agent, or Firm*—Parkhurst & Wendel, L.L.P.

(57) ABSTRACT

A plasma display panel ("PDP") is provided with a protrusion lower than barrier ribs on an inner surface of a back plate substrate, and a phosphor layer formed on a rib surface within a unitary emission unit including a surface of the protrusion, thereby realizing the PDP of high brightness, high luminous efficiency and long operating life. Also, the PDP has a structure, in which a portion of the inner surface of the substrate is opened to a discharge space directly or through a protective layer, so as to improve power consumption remarkably. Further, the invention provides a production of the PDP with superior whiteness by way of controlling a balance of each color with shape of the respective protrusions. Moreover, an electrode can be formed easily and precisely on an upper part of the protrusion by providing a sloped surface for at least one end in a longitudinal direction of the protrusion. As a result, the invention provides the PDP that is of low power consumption, high brightness, high luminous efficiency, and is capable of performing a speedy and stable electric-discharge and displaying white color of high color temperature.

30 Claims, 29 Drawing Sheets

FOREIGN PATENT DOCUMENTS

| | | |
|---|---|---|
| JP | 04036923 | 2/1992 |
| JP | 05041165 | 2/1993 |
| JP | 5-121002 | 5/1993 |
| JP | 5-299022 | 11/1993 |
| JP | 6-44907 | 2/1994 |
| JP | 6-243789 | 9/1994 |
| JP | 7-37511 | 2/1995 |
| JP | 7-111135 | 4/1995 |
| JP | 7-226164 | 8/1995 |
| JP | 7-262930 | 10/1995 |
| JP | 08095500 | 4/1996 |
| JP | 8-222134 | 8/1996 |
| JP | 9-199029 | 7/1997 |

* cited by examiner

PLASMA DISPLAY PANEL, METHOD OF MANUFACTURING THE SAME, AND DISPLAY DEVICE USING THE SAME

FIELD OF THE INVENTION

This invention relates to a plasma display panel, a method of manufacturing the same, and a display device using the same.

BACKGROUND OF THE INVENTION

In present days, plasma display panels ("PDP's") are drawing special attention among flat-panel display techniques, because of reasons that they are capable of delivering a speedier display and a wider viewable angle as compared to liquid crystal panels, easy to upsize a screen, superior in display quality since they are of self-luminous type, and so forth.

In general, the PDP's generate ultraviolet rays by gas discharge, and produce color display by exciting and illuminating phosphor with the ultraviolet rays. A PDP is provided with display cells divided by barrier ribs on a substrate, and phosphor layers are formed in the individual display cells.

In particular, a mainstream of the PDP's at present is a surface-discharge type PDP of 3-electrode structure. The PDP is so constructed that two panels of glass substrates are arranged to face against each other.

A pair of display electrodes are formed side by side in parallel with each other on one of the glass substrates, and an address electrode, which extends in a direction traverse to the display electrodes, a barrier rib and a phosphor layer are formed on the other glass substrate. PDP's suitable for color display are thus manufactured by adopting this structure, which allows a comparatively thick phosphor layer.

FIG. 30 illustrates an exploded perspective view of a surface-discharge type PDP of the prior art having a 3-electrode structure. Display electrodes consisting of a pair of scan electrode 41 and sustain electrode 42 are formed on a front substrate 10 (The substrate formed with these electrodes is hereinafter referred to as "front plate"). Other substrate 20 is provided with a barrier rib 21 with an overcoating layer 24 between them, and a phosphor layer 22 is formed on its surface including a rib surface of the barrier rib (The substrate formed with these layers is hereinafter referred to as "back plate").

An advantage of the above structure is that it is relatively easy to manufacture because of its very simple structure. Moreover, brightness of the display device can be increased, since a luminous surface can be viewed directly in addition to this structure, which allows an increase in thickness of the phosphor layer. Also, because the phosphor layer is arranged at a distance away from the scan electrode, degradation of the phosphor layer due to sustain discharge is reduced.

However, the foregoing structure of the prior art yet has problems that luminous efficiency of the display device is low, and the brightness is also low. Furthermore, degradation of the phosphor due to address discharge is another problem, since the phosphor layer exists in a path of the address discharge as well as vicinity of it. Moreover, if a distance between the address electrode and the scan electrode is increased in order to prevent degradation of the phosphor layer, a voltage for the address discharge needs to be increased, which causes a high-speed address driving difficulty due to a delay in discharge. Further, the increase in voltage of the address discharge leads to other problems such as that it becomes liable to an erroneous discharge between neighboring cells, and so forth. On the other hand, if the distance between the address electrode and the scan electrode is shortened, degradation of the phosphor layer due to the sustain discharge becomes a serious problem. Also, thickness of the phosphor layer can not be increased in order to improve the brightness, since an increase in thickness of the phosphor layer inevitably reduces the discharge space.

Numerous studies have been done heretofore on every problems described above.

Japanese Patent Laid-Open Publication, number H05-121002 discloses a structure, in which phosphor is coated on both of a substrate facing against another substrate at a surface-discharge electrode side and an area of the another substrate in a discharge gap between the surface-discharge electrodes. Also, Japanese Patent Laid-Open Publication, number H05-299022 discloses another structure, in which phosphor is applied on nearly entire rib within a unitary emission unit including a side of a barrier rib and a surface of an address electrode. And, Japanese Patent Laid-Open Publication, number H06-243789 discloses yet another structure, which provides a barrier rib on a back plate approximately perpendicularly, and a phosphor layer on a surface of the barrier rib, wherein this phosphor layer is formed in a manner to taper off gradually. It describes that the structure allows a thick form of phosphor layer without sacrificing an area of discharge space. Further, Japanese Patent Laid-Open Publication, number H07-37511 shows a structure characterized by a phosphor layer, of which a surface is formed with bumps and dips. In addition, the same publication discloses that sides of a barrier rib are formed with bumps and dips, and the phosphor layer covers them uniformly. Furthermore, Japanese Patent Laid-Open Publications, numbers H08-222134, H09-199029, etc. indicate other attempts for increasing surface area of the phosphor layer by devising means of forming the phosphor layer.

There is also Japanese Patent Laid-Open Publication, number H06-44907 for an invention aimed at attempting to reduce a writing voltage, and to increase speediness and certainty of writing. Teaching of the publication, number H06-44907 is to expand an area of a portion of data electrode that faces against a scan electrode, so as to increase a contribution of the data electrode to a writing discharge.

However, the foregoing techniques of the prior art have not realized a PDP having a phosphor layer of high brightness and high luminous efficiency with less degradation of the brightness for a long-term operation, and yet capable of being driven at a high speed.

Furthermore, PDP's of the prior art also have another problem concerning a white balance. It is generally desirable for PDP's to have white color of high color temperature (10,000–9,000K) in the market. In order to produce white color of such a high color temperature, however, it is necessary to increase brightness of blue color comparatively high among those of three colors (red, green and blue). On the contrary, there is a limited variety of phosphor of blue color, and their brightness has not reached to a satisfactory level. Therefore, white balance is normally maintained by suppressing green color, which is high in visibility, by taking certain measures on a driving circuit, and increasing a luminous intensity of blue color, which is low in visibility. As a consequence, brightness of the PDP's decreases further. However, it is the present situation that inventions have not sufficiently accomplished heretofore an improvement of white balance without reducing brightness of the PDP's.

As another problem of PDP's of the prior art, they consume ineffectual power, because a pair of display electrodes 41 and 42 are formed on either a same plane of a substrate 10 or a same plane that is generally in parallel with the substrate 10. The ineffectual power will be described now briefly. In an AC PDP, an electrode, a dielectric layer, a protective layer are normally arranged in a manner to face against each other across a discharge space or in a same surface plane, or in the like manner. Ultraviolet rays are generated by gas discharge in the discharge space, and the ultraviolet rays excite phosphor layer to produce a color display. Therefore, the AC PDP has a function of capacitor between the pair of display electrodes 41 and 42. That is, the PDP consumes ineffectual power by repeating a charge and a discharge of the capacitor, when a voltage is applied alternately between the pair of display electrodes 41 and 42, even if a gas discharge does not occur.

The foregoing will be described here in detail by referring to FIG. 31. In the AC PDP, there are a path 1 not passing through the discharge space and a path 2 through the discharge space between the pair of display electrodes 41 and 42. Therefore, a sum of two capacitances of a capacitor 1 formed by the path 1 and a capacitor 2 formed by the path 2 determines a capacitance of overall capacitors. It is only a charge and discharge of the capacitor 2 that contributes to the gas discharge, but a charge and discharge of the capacitor 1 does not contribute to the gas discharge, out of a charge and discharge of the overall capacitors. Therefore, an electric power consumed for charging and discharging the capacitor 1 becomes ineffectual power. The smaller the ineffectual power becomes, the better it is.

The following inventions disclose attempts to reduce consumption of electric power.

An invention disclosed by Japanese Patent Laid-Open Publication, number H07-226164 is a structure, which provides a first dielectric layer and another dielectric layer for accumulating a wall electric charge, one after another, on a display electrode, and the first dielectric layer is built to such height that it protrudes toward a discharge space higher than the display electrode. In addition, the first dielectric layer and the dielectric layer for accumulating wall electric charge are made so that the former has a low dielectric constant, and the latter has a high dielectric constant. There are also Japanese Patent Laid-Open Publications, numbers H07-111135 and H07-262930 for similar inventions. Also, an invention of Japanese Patent Laid-Open Publication, number H07-37511 is a structure, in which a first electrode driven by a single driver circuit is arranged between second electrodes, a plurality of which are successively switched and driven one after another. However, none of the foregoing examples of the prior art has achieved a sufficient reduction of power consumption.

In order to solve the foregoing problems, an object of the present invention is to provide a plasma display panel of high brightness and high luminous efficiency without causing a degradation of phosphor, as well as having a high speed and stable writing characteristic, a method of manufacturing the same, and a display device using the same.

Another object of the present invention is to provide a PDP that can display white color of high color temperature, a method of manufacturing the same, and a display device using the same.

Still another object of the present invention is to provide a PDP of high efficiency with a reduced ineffectual power that does not contributes to gas discharge, a method of manufacturing the same, and a display device using the same.

SUMMARY OF THE INVENTION

A plasma display panel ("PDP") of the present invention comprises:

a pair of display electrodes formed on a first substrate of a pair of substrates sandwiching a discharge space between them;

an address electrode formed on a second substrate in a direction traverse to the paired display electrodes;

a barrier rib dividing the discharge space into individual unitary emission units; and a phosphor layer, wherein the PDP has a protrusion formed on an inner surface of the second substrate in a height lower than the barrier rib, and the phosphor layer is formed on a rib surface within the unitary emission units of the second substrate including a surface of the protrusion.

Also, a PDP of the present invention comprises:

a first electrode formed on an inner surface of one of a pair of substrates sandwiching a discharge space between them;

a second electrode formed on an inner surface of a second substrate in a direction traverse to the first electrode;

a barrier rib dividing the discharge space into individual unitary emission units; and a phosphor layer, wherein the PDP has a protrusion formed on the inner surface of the second substrate in a height lower than the barrier rib, and further wherein the second electrode is provided on an upper part of the protrusion, and the phosphor layer is formed on a rib surface within the unitary emission units including the protrusion.

Further, a PDP of the present invention is characterized by controlling a luminous balance of individual colors (red, green and blue) of the phosphor layer by a shape of the protrusion. This enables the PDP to increase whiteness of a display without reducing a luminous efficiency.

Furthermore, a PDP of the present invention is a surface-discharge type plasma display panel comprising:

a pair of display electrodes formed on an inner surface of a first substrate of a pair of substrates sandwiching a discharge space between them; and a dielectric layer and a protective layer formed, one after another, on the paired display electrodes, wherein a part of an inner surface of the first substrate is opened to the discharge space either directly or through the protective layer.

Accordingly, the foregoing structures enable the PDP to reduce ineffectual power and to substantially improve efficiency.

In addition, the present invention is characterized by forming a gradually sloped surface at a distal end in a longitudinal direction of a protrusion during a process of manufacturing the PDP of the present invention. This structure realizes formation of an electrode line steadily on an upper part of the protrusion, thereby achieving a reduction of address voltage.

In the foregoing teaching of the present invention, the protrusion is meant to be a portion that extrudes partially, and that its shape, location and quantity are not restrictive. The same also applies to its material.

DESCRIPTION OF THE PREFERRED EMBODIMENTS

Preferred exemplary embodiments will be described hereinafter with reference to the accompanied figures.

First Exemplary Embodiment

Figure 1:
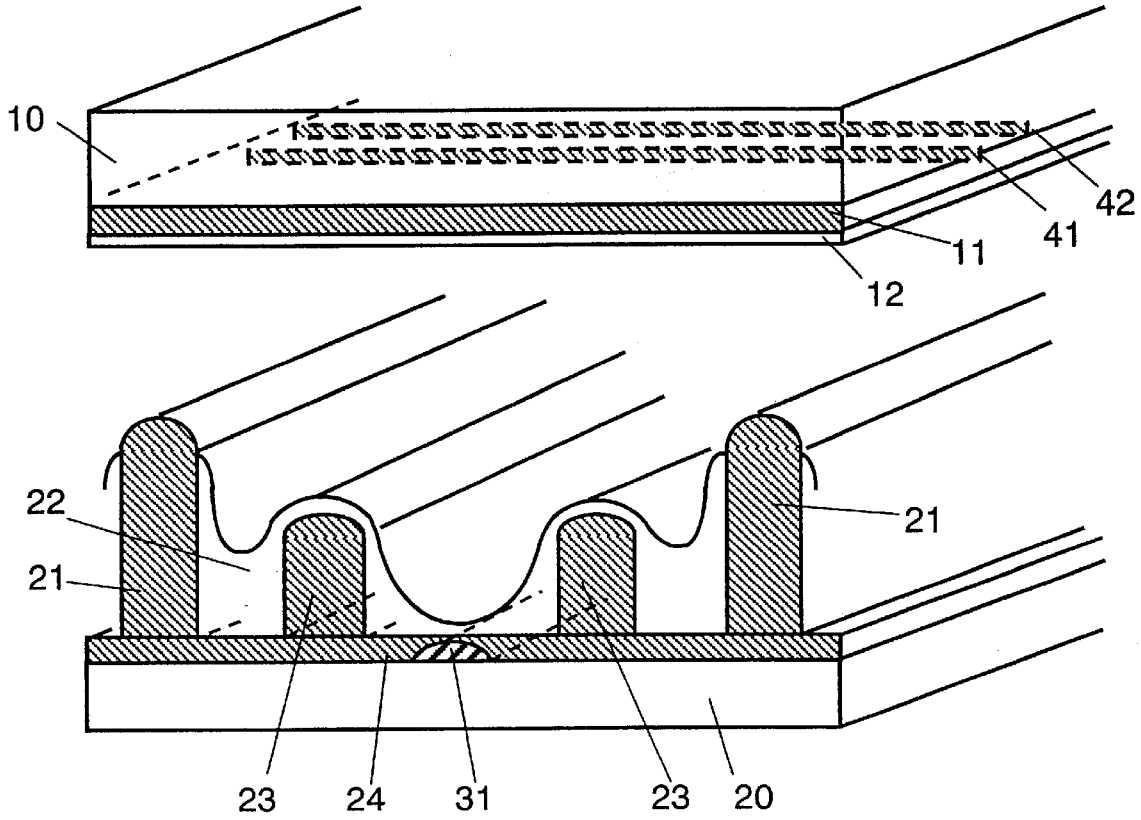
FIG. 1 is an exploded perspective view depicting a PDP of a first exemplary embodiment of the present invention.

FIG. 1 is a typical exploded perspective view of a PDP of a first exemplary embodiment of the present invention.

The PDP of this exemplary embodiment comprises: a pair of display electrodes 41 and 42 formed on an inner surface of a substrate 10 out of a pair of substrates sandwiching a discharge space between them; an address electrode 31 formed on another substrate 20 in a direction traverse to the paired display electrodes 41 and 42; barrier ribs 21 dividing the discharge space into individual unitary emission units ("EU's"); and a phosphor layer 22 for illuminating by an electric discharge. Further, the PDP of this exemplary embodiment has protrusions 23 formed on the inner surface of the substrate 20 in a height lower than the barrier rib 21, and the phosphor layer 22 is formed on a rib surface in the EU's of the substrate, including a surface of the protrusions 23.

Soda lime glass is widely used as material of the substrate 10, but this is not restrictive. It is a general practice to use glass of low melting point as material of the barrier ribs 21, but again this is not restrictive. Also, the barrier ribs 21 can be formed by means of screen printing, sand blasting, using photo-sensitive paste, photolithography and burying, compression molding, or the like method.

The protrusions 23 can be formed readily with the same material as the barrier ribs 21 by the same method as the barrier ribs 21. However, it need not be of the same material as the barrier ribs 21, nor is it formed by the same method as the barrier ribs 21. Also, the protrusions 23 can be arranged in any height, shape, location and number according to the necessity. Further, the protrusions 23 may be formed in contact with the barrier ribs 21. Furthermore, a plurality of the protrusions 23 can be formed in a manner that they are in contact with one another.

The phosphor layer 22 may be of any material without a specific limitation, so long as it illuminates by being excited with ultraviolet rays generated by the gas discharge. The phosphor layer 22 can be formed by such methods as screen-printing and ink-jet printing.

The present exemplary embodiment will be described hereinafter concretely by referring to FIG. 1.

In the PDP of FIG. 1, the barrier rib 21 is formed in a striped pattern, and two lines of the protrusions 23, also in the striped pattern, are provided generally in parallel to the barrier rib 21 in each cell. The address electrode 31 is provided in a middle position between the two lines of protrusions 23 in generally parallel with the protrusions 23.

A phosphor layer 22 is formed on the address electrode 31 after an overcoating layer 24 of dielectric material. A scan electrode 41 and a sustain electrode 42, which are in parallel to each other and constitute a pair, are formed on an inner surface of the front side substrate 10 in a manner generally orthogonal to the address electrode 31, and that both of the scan electrode 41 and the sustain electrode 42 are covered by a transparent dielectric layer 11 and a protective layer 12.

A concrete manufacturing process for the PDP of FIG. 1 will be described next.

A manufacturing process of a back plate is described first. A substrate 20 used here was a soda lime glass plate in a thickness of 2.8 mm. First, a silver address electrode 31 was formed on the substrate 20 by screen-printing silver paste, XFP5392 (A product of Namics Corporation), followed by drying (at 150° C.), and firing (at 550° C.).

Next, an overcoating layer 24 was formed on the address electrode 31 by screen-printing dielectric paste, Prototype G3-2083 (A product of Okuno Chemical Industries Co., Ltd.), followed by drying (at 150° C.), and firing (at 550° C.).

Figure 2:
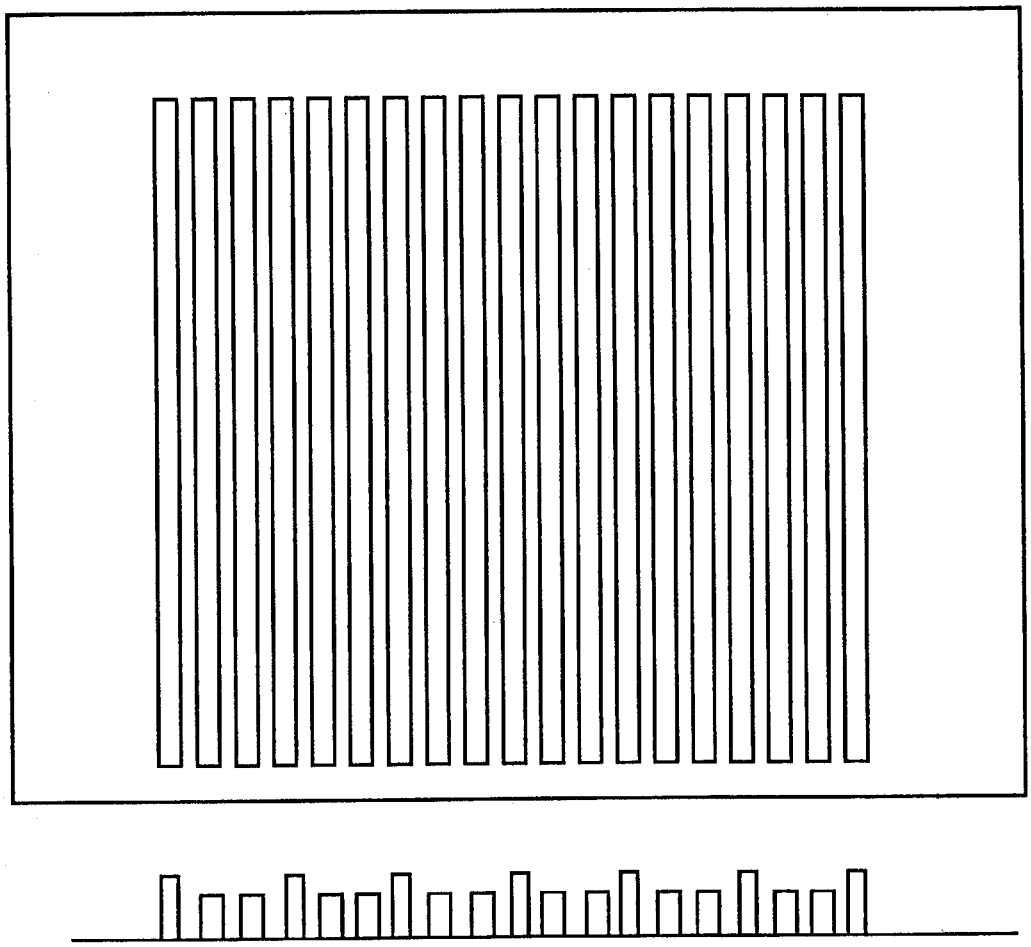
FIG. 2 illustrates a printing pattern of barrier ribs and protrusions.
Figure 3:
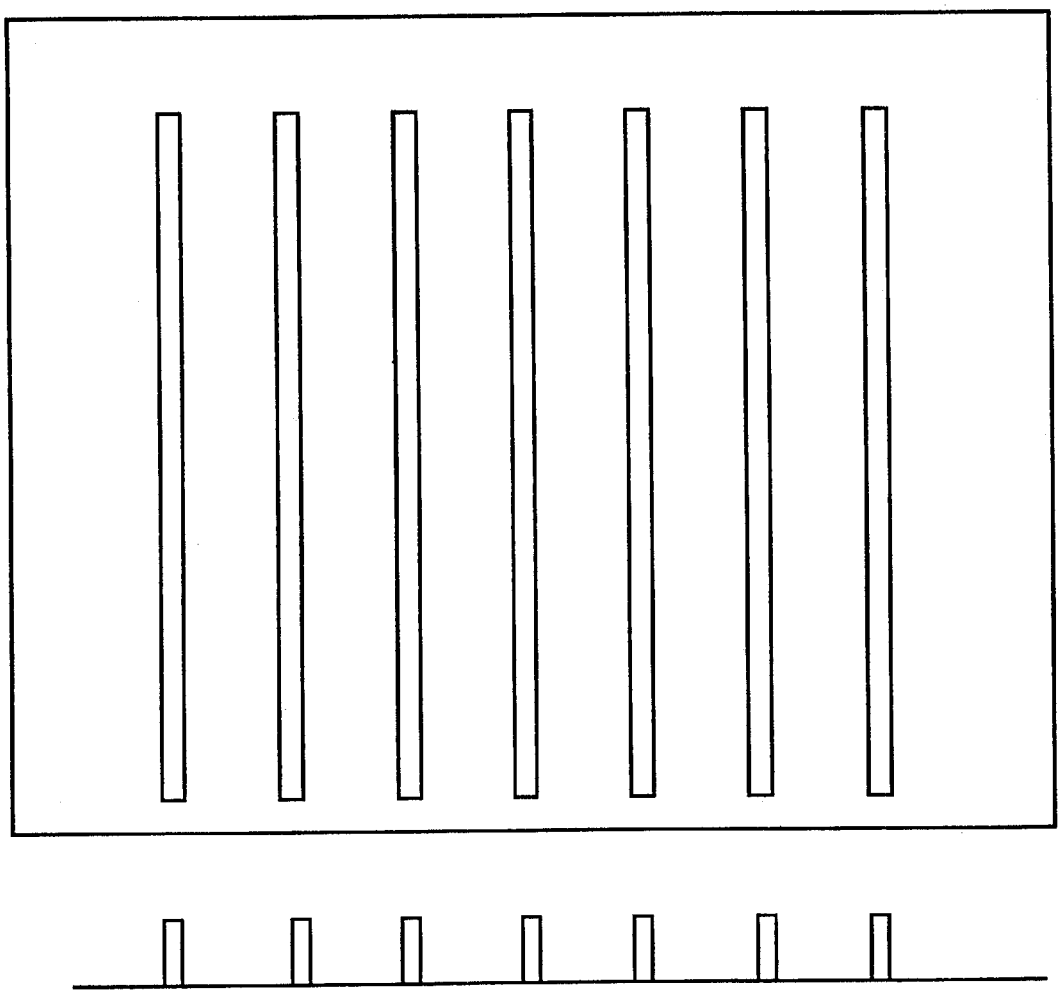
FIG. 3 illustrates a printing pattern of barrier ribs.

Barrier ribs 21 and protrusions 23 in predetermined heights were formed next, by screen-printing rib paste, G3-1961 (A product of Okuno Chemical Industries Co., Ltd.) with a screen mask having a pattern shown in FIG. 2, and drying (at 150° C.). A remaining portion of the barrier ribs 21 was formed consecutively into a predetermined height by screen-printing the same rib paste with a screen mask for the barrier ribs having a pattern shown in FIG. 3, and drying (at 150° C.). A top portion of the barrier ribs 21 was further formed continuously by screen-printing rib paste ELD-507B (A product of Okuno Chemical Industries Co., Ltd.) with the screen mask for the barrier ribs, and drying (at 150° C.). The barrier ribs 21 and the protrusions 23 were formed subsequently by firing the substrate at 550° C. The protrusions 23 can be formed easily by adding their pattern into a pattern of the barrier rib 21 in this manner.

A phosphor layer 22 was formed next between the barrier ribs 21 constructed as above. The phosphor layer 22 was formed by printing red sulphor paste (A product of Okuno Chemical Industries Co., Ltd.), green sulphor paste (A product of Okuno Chemical Industries Co., Ltd.) and blue sulphor paste (A product of Okuno Chemical Industries Co., Ltd.) one after another with screen-printing, followed by drying (at 150° C.) and firing (at 500° C.). The back plate was made with the foregoing operation.

A process of manufacturing a front plate will be described next. A substrate 10 used here was a soda lime glass plate in a thickness of 2.8 mm. Display electrodes 41 and 42 were formed on the substrate 10 by depositing chromium, copper and chromium in this order with a vacuum evaporation method. Next, a dielectric layer 11 was formed over the display electrodes 41 and 42 by screen-printing dielectric paste, G3-0496 (A product of Okuno Chemical Industries Co., Ltd.), followed by drying (at 150° C.), and firing (at 550° C.).

Then, a protective layer 12 was formed by depositing protective layer material of MgO over the dielectric layer 11 with a vacuum evaporation method, and the front plate was completed.

The PDP was manufactured by arranging face to face the front plate and the back plate produced in the foregoing processes, sealing a periphery of them with frit glass, and charging it with gas (a mixture of Ne gas with 5% Xe, at a pressure of 450 torr) after sufficient evacuation of air.

A display device of the present exemplary embodiment will be described now. A display device using the PDP of FIG. 1 is described here as an example.

Figure 4:
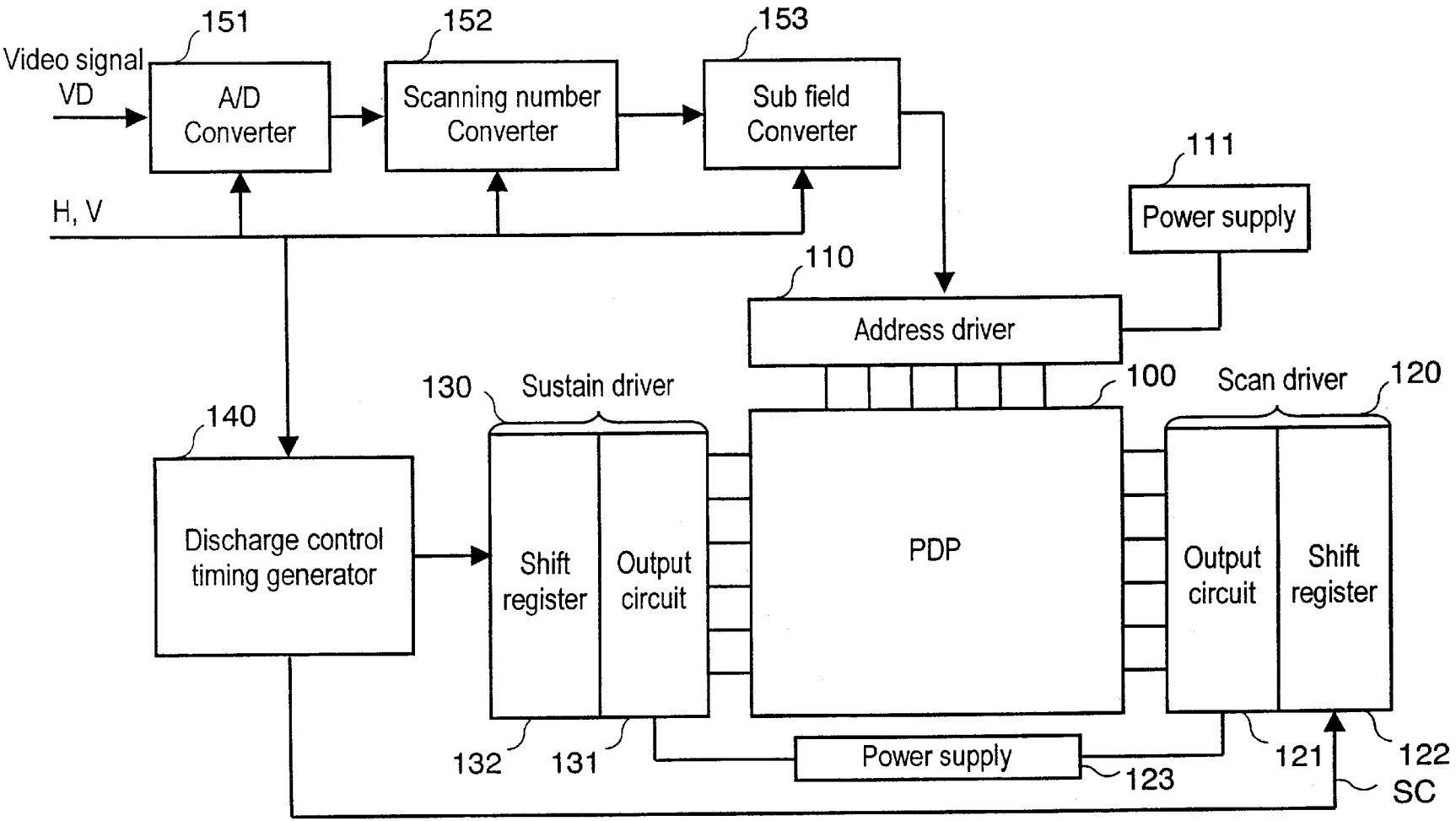
FIG. 4 is a block diagram depicting a structure of a display device.

FIG. 4 is a block diagram depicting a structure of the display device of the present exemplary embodiment. The display device of FIG. 4 comprises a PDP 100, an address driver 110, a scan driver 120, a sustain driver 130, a discharge control timing generator 140, an A/D converter 151, a scanning number converter 152, and a sub-field converter 153.

The PDP 100 contains a plurality of address electrodes 31, a plurality of scan electrodes 41 and a plurality of sustain electrodes 42, and that the plurality of address electrodes 31 are arranged in a vertical direction of a picture screen, and the plurality of scan electrodes 41 and the plurality of sustain electrodes 42 are arranged in a horizontal direction of the picture screen. Besides, the plurality of sustain electrodes 42 are connected commonly. Also, an individual discharge cell is formed at each point of intersection among the address electrodes 31, the scan electrodes 41 and the sustain electrodes 42, and each discharge cell composes a pixel on the picture screen.

Discharge cells are chosen by producing address discharges between the address electrodes 31 and the scan electrodes 41 with an application of writing pulse between the address electrodes 31 and the scan electrodes 41 on the PDP 100. A display is made subsequently by producing sustain discharges between the scan electrodes 41 and the sustain electrodes 42 with an application of cyclic sustaining pulse, which reverses alternately, between the scan electrodes 41 and the sustain electrodes 42.

Figure 5:
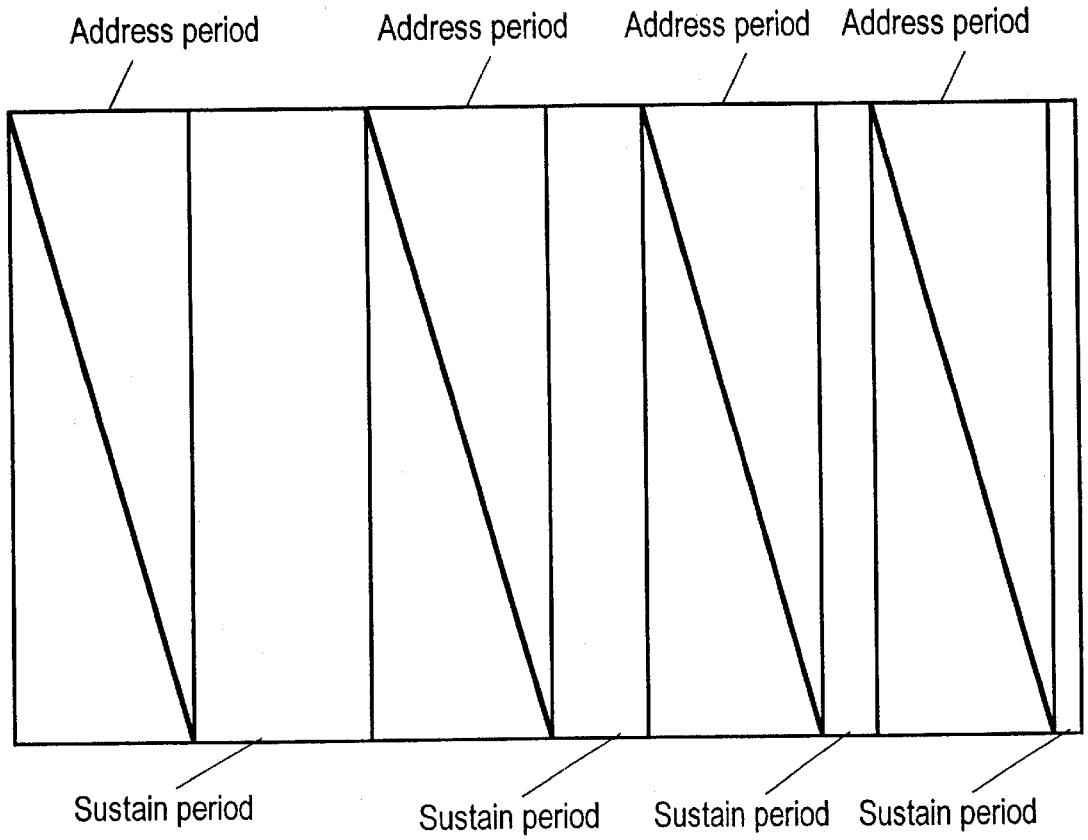
FIG. 5 is a diagram depicting a driving method of a display device.

An ADS (Address and Display-period Separated) method may be used as an example of gradation display driving methods in the AC PDP. FIG. 5 is a drawing for help in describing the ADS method. The axis of ordinates in FIG. 5 represents a scanning direction (vertical scanning direction) of the scan electrodes from a first line to an "m"th line, and the axis of abscissas represents a lapse of time. In the ADS method, one field (1/60 second=16.67 ms) is divided into a plurality of sub-fields on time basis. For example, one field is divided into eight sub-fields when making a display of 256 gradations with 8 bits. Also, individual sub-fields are separated into an address period, in which an address discharge is carried out for selecting a lighting-up cell, and a sustain period, in which a sustain discharge is carried out for display. In the ADS method, a scanning by the address discharge is carried out in the entire screen of the PDP between the first line and the "m"th line during each sub-field, and the sustain discharge is commenced at an end of the address discharge in the entire screen.

First, a video signal VD is fed into the A/D converter 151. A horizontal synchronizing signal H and a vertical synchronizing signal V are fed at the same time into the discharge control timing generator 140, the A/D converter 151, the scanning number converter 152 and the sub-field converter 153. The A/D converter 151 converts the video signal VD into a digital signal, and supplies the video data to the scanning number converter 152.

The scanning number converter 152 converts the video data into a video data having a number of lines corresponding to a number of pixels of the PDP, and supplies the video data for each of every lines to the sub-field converter 153. The sub-field converter 153 divides an individual pixel data of the video data for each line into a plurality of bits corresponding to a plurality of the sub-fields, and outputs each bit of the individual pixel data for each sub-field, individually in serial order, to the address driver 110.

The address driver 110, which is connected to a power supply 111, converts the data for each sub-field supplied in serial order from the sub-field converter 153 into a paralleled data, and drives the plurality of address electrodes according on the paralleled data.

The discharge control timing generator 140 generates discharge control timing signals SC and SU based on the horizontal synchronizing signal H and the vertical synchronizing signal V, and supplies respective signals to the scan driver 120 and the sustain driver 130. The scan driver 120 contains an output circuit 121 and a shift register 122. Also, the sustain driver 130 contains an output circuit 131 and a shift register 132. Both of the scan driver 120 and the sustain driver 130 are connected to a common power supply 123.

The shift register 122 in the scan driver 120 supplies the discharge control timing signal SC provided by the discharge control timing generator 140, to the output circuit 121 while shifting it toward the vertical scanning direction. The output circuit 121 drives the plurality of scan electrodes in a sequential order in response to the discharge control timing signal SC supplied by the shift register 122. The shift register 132 in the sustain driver 130 supplies the discharge control timing signal SU provided by the discharge control timing generator 140, to the output circuit 131 while shifting it toward the vertical scanning direction. The output circuit 131 drives the plurality of the sustain electrodes in a sequential order in response to the discharge control timing signal SU supplied by the shift register 132.

Figure 6:
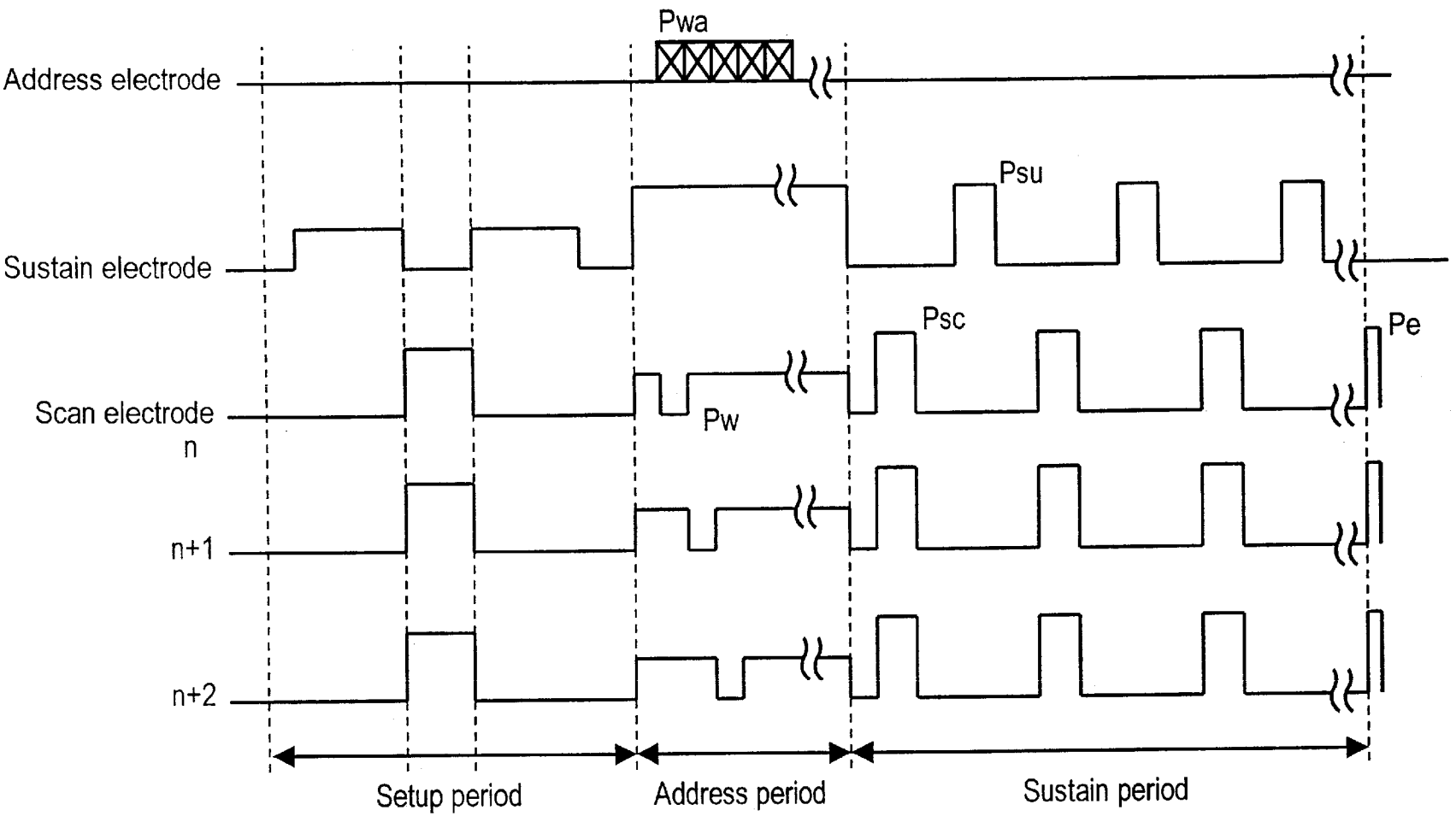
FIG. 6 is a timing chart depicting a driving voltage applied to individual electrodes of a PDP.

FIG. 6 is a timing chart showing a driving voltage applied to each of the electrodes in the PDP 100. FIG. 6 shows driving voltages for the address electrode, the sustain electrode, and the scan electrodes between an "n"th line and an "n+2"th line. The character "n" denotes an integer of any number in this instance. The sustain electrodes are applied with a sustaining pulse (Psu) at predetermined intervals during a emitting period as shown in FIG. 6. The scan electrodes are applied with a writing pulse (Pw) during an address period. The address electrodes are applied with a writing pulse (Pwa) in synchronization with the writing pulse (Pw). A rise and a fall of the writing pulse (Pwa) applied to the address electrodes are controlled according to an image to be displayed in each pixel. An address discharge occurs in a discharge cell at a point of intersection between the scan electrode and the address electrode, when the writing pulse (Pw) and the writing pulse (Pwa) are applied at the same time, so as to light up the discharge cell.

The scan electrodes are applied with a sustaining pulse (Psc) at predetermined intervals during a sustain period after the address period. Phase of the sustaining pulse (Psc) applied to the scan electrodes is shifted by 180 degrees with phase of the sustaining pulse (Psc) applied to the sustain electrodes. The sustain discharge occurs only in the discharge cell lit up by the address discharge in this case. The scan electrodes are applied with an erasing pulse (Pe) at an end of each sub-field. Application of the erasing pulse (Pe) to the scan electrodes extinguishes or reduces a wall charge in each discharge cell to such a degree that prohibits the sustain discharge from continuing, so as to terminate the sustain discharge. The scan electrodes are applied with a restraining pulse (Pr) at predetermined intervals during a pause period after application of the erasing pulse (Pe). The restraining pulse (Pr) is in the same phase with the sustaining pulse (Psu).

Described hereinafter is a result of evaluation conducted on brightness and luminous efficiency of the foregoing display device by illuminating its screen entirely. A color analyzer, CA-100 (manufactured by Minolta Co., Ltd.) was used for the evaluation of brightness. A luminous efficiency was obtained by dividing a light flux calculated from the brightness by an electric power supplied to it during the electric-discharge.

A result obtained from the foregoing evaluation is shown in Table 1. Incidentally, it also shows a result obtained on a display device, which employs a PDP not having a protrusion (a height of the protrusion being 0 $\mu$m), for a purpose of comparison.

TABLE 1

| Height of Barrier rib $\mu$m | Height of Protrusion $\mu$m | Initial brightness cd/m$^2$ | Luminous Efficiency lm/W | Degradation in brightness of phosphor (%) |
|---|---|---|---|---|
| 120 | 0 | 101 | 0.8 | 42 |
| 120 | 60 | 119 | 0.94 | 35 |
| 240 | 120 | 138 | 1.09 | 22 |
| 240 | 180 | 148 | 1.17 | 19 |

Table 1 reveals that high brightness and high luminous efficiency can be attained by providing the protrusions 23, which can increase an effective area of the phosphor layer 22 within the EU's. Table 1 also reveals that placing of the protrusions 23 reduces a degree of degradation of the phosphor layer (degradation in brightness) due to a long-term operation.

Second Exemplary Embodiment

Figure 7:
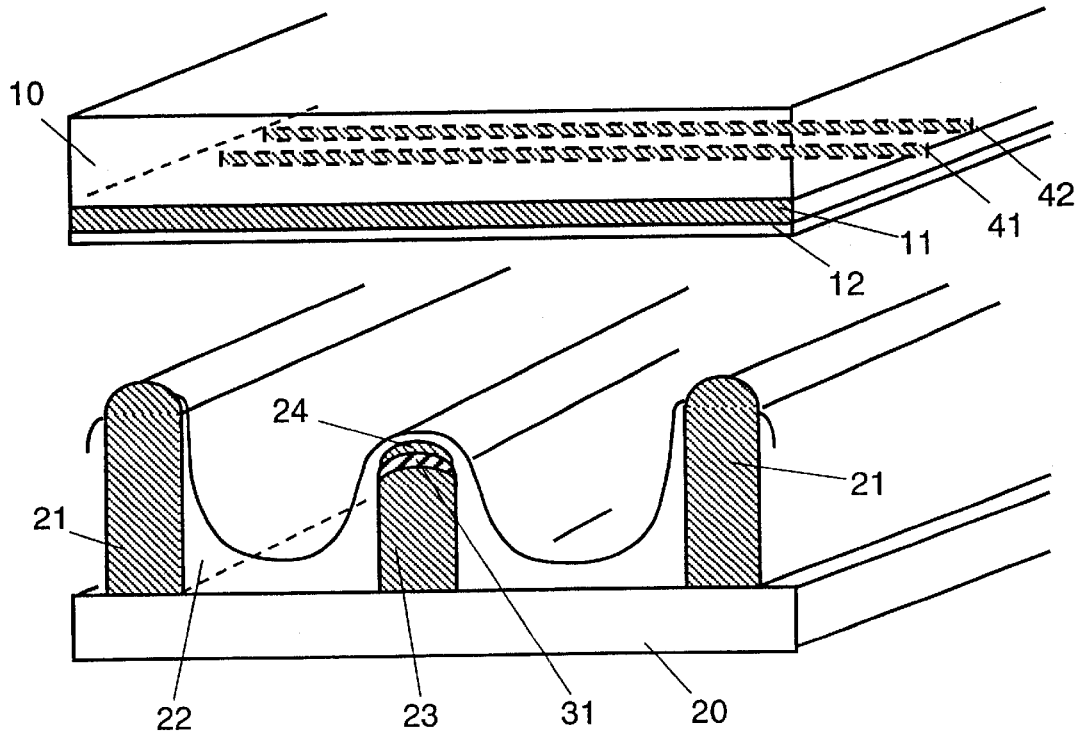
FIG. 7 is an exploded perspective view depicting a PDP of a second exemplary embodiment of the present invention.

FIG. 7 is a typical exploded perspective view of a PDP of a second exemplary embodiment of the present invention.

In the PDP of FIG. 7, barrier ribs 21 are formed in a striped pattern, and a line of protrusion 23, also in a striped pattern, is provided in parallel to the barrier ribs 21 in a center of each cell. An address electrode 31 is provided on an upper part of the protrusion 23. A phosphor layer 22 is formed over the address electrode 31 with an overcoating layer 24 of dielectric material between them. A structure of a front plate is identical to that of the first exemplary embodiment.

Next, a concrete manufacturing process for the PDP of FIG. 7 will be described. A manufacturing process of the front plate is not described, as it is same as that of the first exemplary embodiment.

Figure 8:
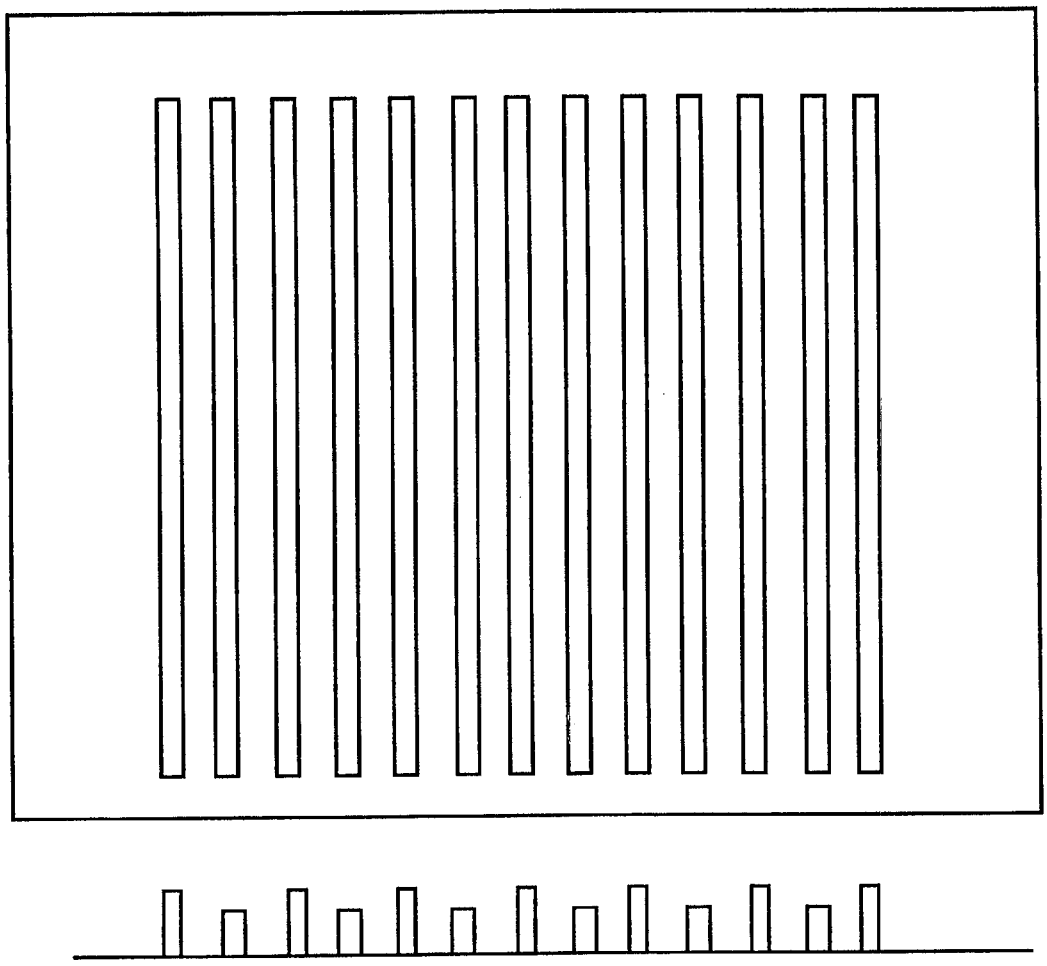
FIG. 8 illustrates a printing pattern of barrier ribs and protrusions.

A substrate 20 used here was a soda lime glass plate in a thickness of 2.8 mm. Barrier ribs 21 and a protrusion 23 in predetermined heights were formed by screen-printing rib paste, G3-1961, with a pattern shown in FIG. 8 for barrier ribs 21 and protrusion 23, and drying (at 150° C.). Then, a silver address electrode 31 was formed on an upper part of the protrusion 23 by screen-printing silver paste, XFP5392, and drying (at 150° C.). Next, an overcoating layer 24 was formed over the address electrode 31 by screen-printing dielectric paste, Prototype G3-2083 (A product of Okuno Chemical Industries Co., Ltd.), and drying (at 150° C.). Further, the barrier ribs 21 and the protrusion 23 were formed consecutively by taking the same steps as those of the first exemplary embodiment.

Subsequently, a phosphor layer 22 was formed between the barrier ribs 21 constructed as above with the same steps as those of the first exemplary embodiment.

A result of evaluation that has been conducted on brightness, luminous efficiency and an address characteristic of a display device employing the PDP of the present exemplary embodiment is shown in Table 2. It also shows a result obtained on a display device, which employs a PDP not provided with a protrusion, for a purpose of comparison.

TABLE 2

| Height of barrier rib μm | Height of protrusion μm | Initial brightness cd/m² | Luminous efficiency lm/W | Degradation in brightness of phosphor (%) | Address characteristics |
|---|---|---|---|---|---|
| 120 | 0 | 101 | 0.8 | 42 | Δ |
| 120 | 60 | 119 | 0.94 | 35 | ⊙ |
| 240 | 120 | 138 | 1.09 | 22 | Δ |
| 240 | 180 | 148 | 1.17 | 19 | ⊙ |

Table 2 reveals that placing of the protrusions 23 improves brightness and luminous efficiency, and reduces a degree of degradation of the phosphor layer 22 due to a long-term operation.

Also, placing of the address electrode 31 on the upper part of the protrusion 23 can realize a PDP of high brightness and high luminous efficiency with less degradation due to a long-term operation, because of no impairment to the address discharge characteristic even with high barrier ribs.

In addition, placing of the address electrode 23 on the upper part of the protrusion 23 can improve the address characteristic substantially with respect to speediness and reliability.

Although the barrier ribs 21 are formed in a striped pattern in the PDP of the present exemplary embodiment, the protrusion 23 and the address electrode 31 can be formed in a lattice pattern. In other words, the protrusions 23 and the address electrodes 31 may be formed in two directions, one being generally in parallel with the barrier ribs 21, and the other being generally in parallel with the scan electrode 41 as well as the sustain electrode 42, so that the address electrodes 31 are formed in such structure that they are separated by the barrier ribs 21.

The above-described structure can be expected to produce an even speedier and stable address discharge, since the address electrodes 31 can be positioned directly below the scan electrode 41.

Third Exemplary Embodiment

Figure 9:
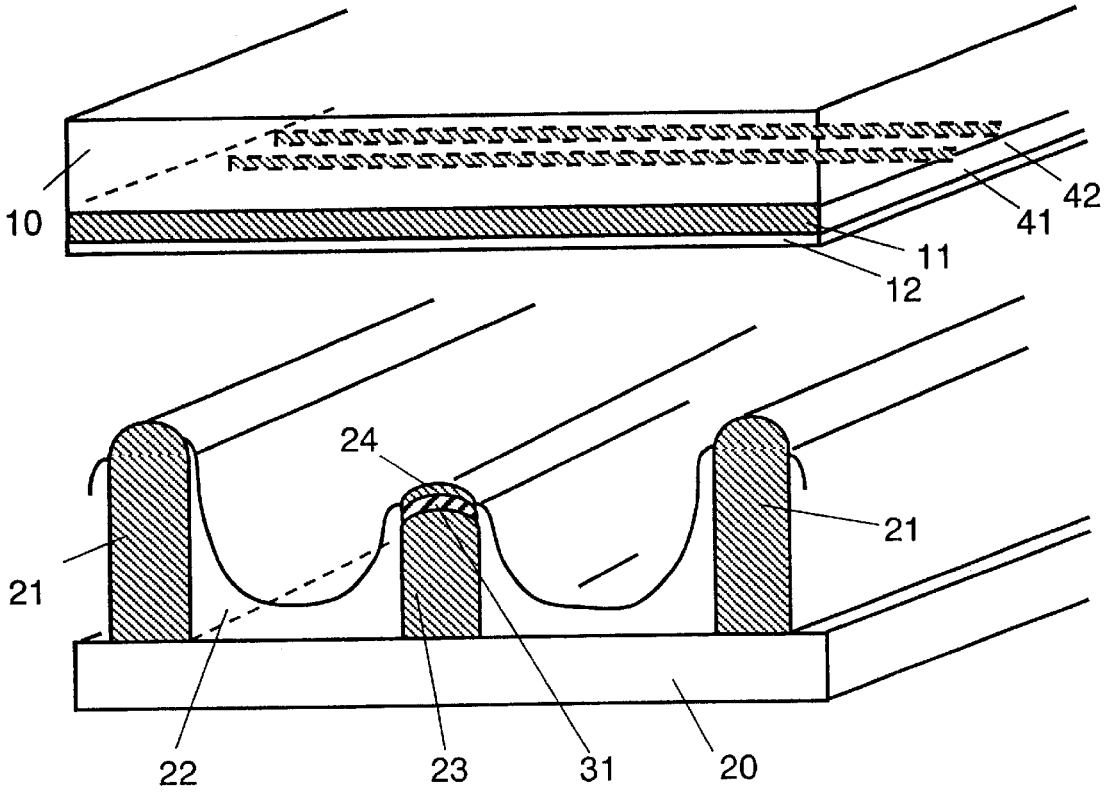
FIG. 9 is an exploded perspective view depicting a PDP of a third exemplary embodiment of the present invention.

FIG. 9 is a typical exploded perspective view of a PDP of a third exemplary embodiment of the present invention. The present exemplary embodiment has a structure, in which the phosphor layer 22 is removed from an upper surface of the address electrode in the structure of the second exemplary embodiment.

A method of manufacturing the PDP of the present exemplary embodiment is identical to that of the second exemplary embodiment, except that the phosphor is printed in a manner not to form the phosphor layer 22 on the overcoating layer 24 above the address electrode.

An evaluation was conducted on a display device employing the PDP of the present exemplary embodiment for brightness and luminous efficiency.

A result has shown that both of brightness and luminous efficiency are improved in the same way as in the case of the second exemplary embodiment. Moreover, degradation of the phosphor layer (degradation of brightness and change of chromaticity) is reduced, and the address discharge is stabilized because of removal of the phosphor layer 22 from the upper surface of the address electrode 31. Furthermore, the present exemplary embodiment has improved the address characteristic substantially with respect to speediness and stability.

Forth Exemplary Embodiment

Figure 10:
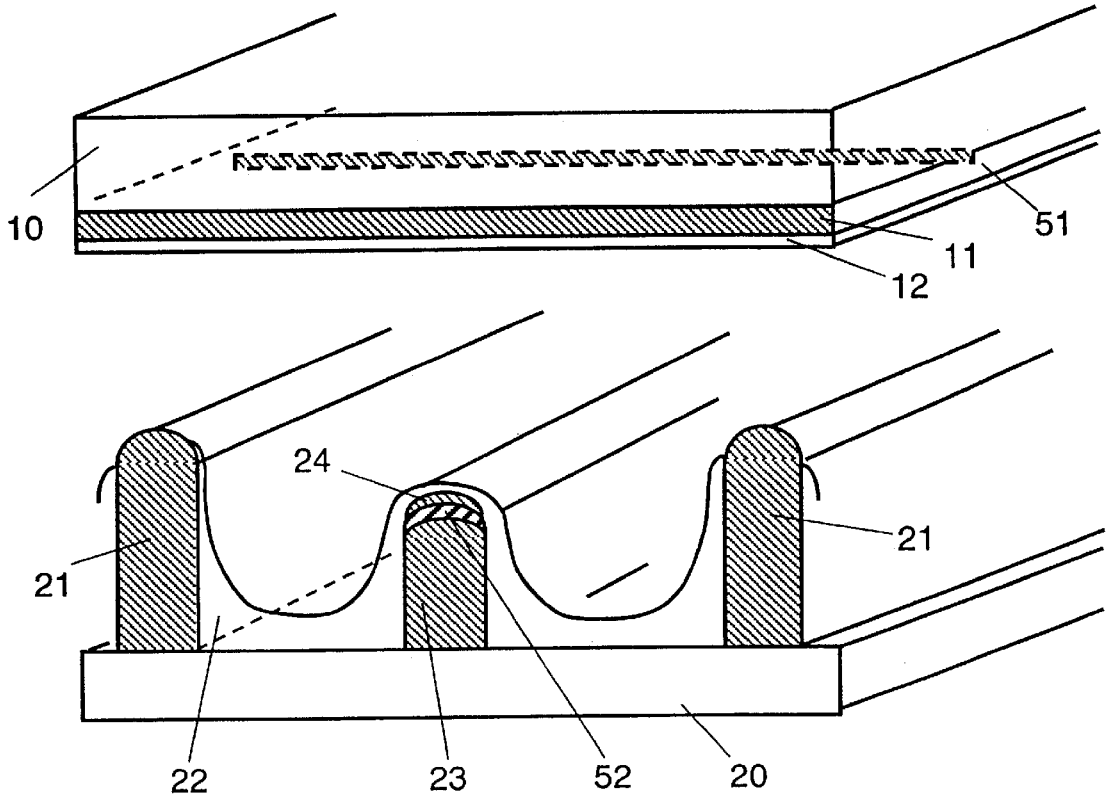
FIG. 10 is an exploded perspective view depicting a PDP of a fourth exemplary embodiment of the present invention.

FIG. 10 is a typical exploded perspective view of a PDP of a fourth exemplary embodiment of the present invention.

In the PDP of FIG. 10, barrier ribs 21 are formed in a striped pattern, and a line of protrusion 23, also in a striped pattern, is provided generally in parallel to the barrier ribs 21 in a center of each cell. A display electrode 52 also serving an address electrode is provided on an upper part of the protrusion 23. A phosphor layer 22 is formed on the display electrode 52 with an overcoating layer 24 of dielectric material between them. A display electrode 51 is formed on an inner surface of a front side substrate 10 in a manner generally orthogonal to the address/display electrode 52, and that the display electrode 51 is covered by a transparent dielectric layer 11 and a protective layer 12.

The PDP of the present exemplary embodiment will be described hereinafter. A manufacturing process of a back plate for the PDP of this exemplary embodiment is identical to that of the second exemplary embodiment.

Next, a manufacturing process for the front plate will be described. A substrate 10 used here was a pane of soda lime glass in a thickness of 2.8 mm. A display electrode 51 was formed on the substrate by depositing chromium, copper and chromium in this order with a vacuum evaporation method. Next, a dielectric layer 11 was formed on top of the display electrode 51 by screen-printing dielectric paste, G3-0496, followed by drying (at 150° C.), and firing (at 580° C.). Then, a protective layer 12 was formed by depositing protective layer material of MgO over the dielectric layer 11 with a vacuum evaporation method.

The PDP was manufactured by arranging face to face the front plate and the back plate produced in the foregoing process, sealing a periphery of them with frit glass, evacuating air sufficiently, charging it with gas (a mixture of Ne gas with 5% Xe, at a pressure of 450 torr), and tipping off, i.e., sealing a tube through which the gas is charged.

A display device in the present exemplary embodiment will be described now. The display device of the present exemplary embodiment is same as the display device of the first exemplary embodiment in principle. In other words, the same operation as that of the first exemplary embodiment can be realized by assigning a function of the scan electrode 41 of the first exemplary embodiment to the display electrode 51, a function of the sustain electrode 42 to the address/display electrode 52, and a function of the address electrode 31 to also the address/display electrode 52.

The PDP 100 in FIG. 4 contains a plurality of the address/display electrodes 52, and a plurality of the display electrodes 51, and that the plurality of address/display electrodes 52 are arranged in a vertical direction of a picture screen, and the plurality of display electrodes 51 are arranged in a horizontal direction of the picture screen. Also, an individual discharge cell is formed at each point of intersection between the address/display electrodes 52 and the display electrodes 51, and each discharge cell composes a pixel on the picture screen. Discharge cells are chosen by producing address discharges between the address/display electrodes 52 and the display electrodes 51 with an application of writing pulse between the address/display electrodes 52 and the display electrodes 51 on the PDP 100. Then, a display is made subsequently by producing sustain discharges between the display electrodes 51 and the address/display electrodes 52 with an impression of cyclic sustaining pulse, which reverses alternately, between the display electrodes 51 and the address/display electrodes 52.

An evaluation was conducted on the display device of the present exemplary embodiment for brightness and luminous efficiency by illuminating its screen entirely. A result has shown that placing of the protrusion 23 improves the brightness and luminous efficiency while reducing a degree of degradation of the phosphor layer (degradation of brightness and change of chromaticity) due to a long term operation.

In addition, placing of the display electrode 52 having a function of the address electrode on the upper part of the protrusions 23 has realized a PDP of high brightness and high luminous efficiency with less degradation due to long-term operation. A bad effect to a discharge characteristic was not found even with high barrier ribs 21. Also, the discharge characteristic has been improved substantially with respect to speediness and stability.

Fifth Exemplary Embodiment

Figure 11:
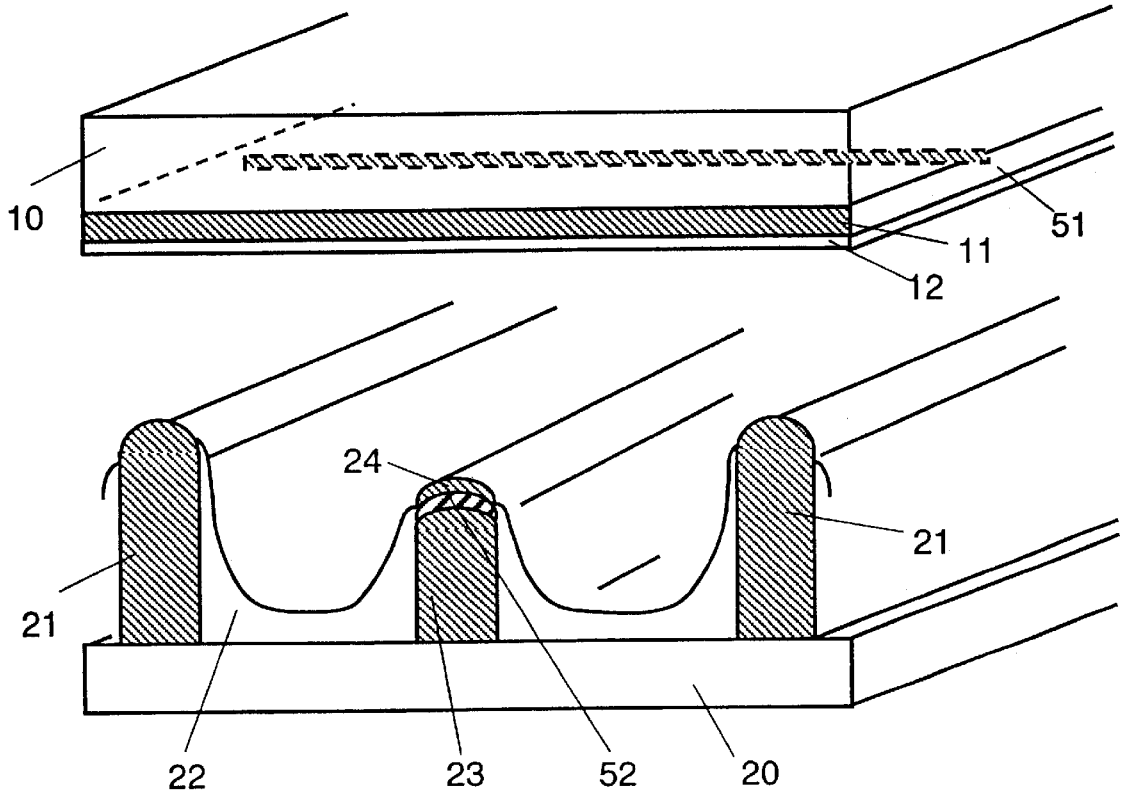
FIG. 11 is an exploded perspective view depicting a PDP of a fifth exemplary embodiment of the present invention.

FIG. 11 is a typical exploded perspective view of a PDP of a fifth exemplary embodiment of the present invention. The PDP of the present exemplary embodiment has a structure, in which the phosphor layer is not formed on the overcoating layer 24 made on the display electrode 52 having a function of the address electrode, in the structure of the fourth exemplary embodiment. A method of manufacturing the PDP of this exemplary embodiment is identical to that of the fourth exemplary embodiment, except that the phosphor layer 22 is formed over an area other than the top of the overcoating layer 24.

A display device employing the PDP of this exemplary embodiment also operates in the same manner as that of the fourth exemplary embodiment.

A result of evaluation conducted on the foregoing display device for brightness and luminous efficiency by illuminating its screen entirely has revealed that it reduces degradation of the phosphor layer even farther than that of the fourth exemplary embodiment. It can also achieve speedy and steady discharges in the similar condition as in the case of the fourth exemplary embodiment.

As has been described, the present invention can increase an effective area of the phosphor layer 22 within the EU's, and improve luminous efficiency and brightness. This is due to the providing of the protrusion 23 lower than the barrier ribs 21 on an inner surface of the substrate 20 and forming the phosphor layer 22 over a rib surface including a surface of the protrusion 23 in the EU's.

Also, placing of the protrusion reduces a degree of degradation of the phosphor layer due to long-term operation. Further, placing of the display electrode 52 having a function of the address electrode on the protrusion can realize a PDP of high brightness and high luminous efficiency with less degradation due to a long-term operation, because of no impairment to a discharge characteristic even with high barrier ribs 21. Moreover, the discharge characteristic can be improved remarkably with respect to speediness and stability.

In addition, degradation of the phosphor (degradation of brightness and change of chromaticity) is farther reduced, and discharges are stabilized because of the removal of phosphor layer 22 from the upper surface of the display electrode 52 having a function of the address electrode.

Sixth Exemplary Embodiment

Figure 12:
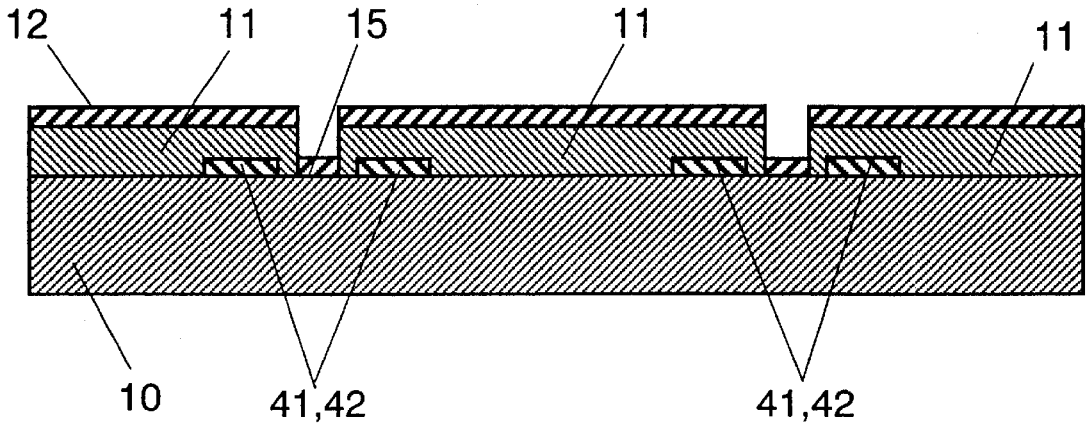
FIG. 12 is a cross-sectional view depicting a front plate of a PDP of a sixth exemplary embodiment of the present invention.

FIG. 12 is a typical cross-sectional view depicting a front plate of a PDP of a sixth exemplary embodiment of the present invention.

In the PDP of FIG. 12, a pair of display electrodes 41 and 42 are formed directly on an inner surface of a substrate 10 out of a pair of substrates sandwiching a discharge space between them, and a dielectric layer 11 and a protective layer 12 are formed on them one after another. A portion 15 of the inner surface of the substrate 10 is opened to the discharge space through the protective layer 12. The portion 15 is in a striped pattern, and it lies between the display electrodes 41 and 42 in generally parallel with them.

A manufacturing process of the PDP of this exemplary embodiment will be described next. A back plate was produced in the same manner as that of the first exemplary embodiment.

A manufacturing process of a front plate will be described hereinafter. A substrate 10 used here was a soda lime glass plate in a thickness of 2.8 mm. Display electrodes were formed on the substrate by depositing chromium, copper and chromium in this order with a vacuum evaporation method. Next, a dielectric layer was formed over the display electrodes by screen-printing dielectric paste, G3-0496, followed by drying (at 150° C.), and firing (at 580° C.).

Figure 13:
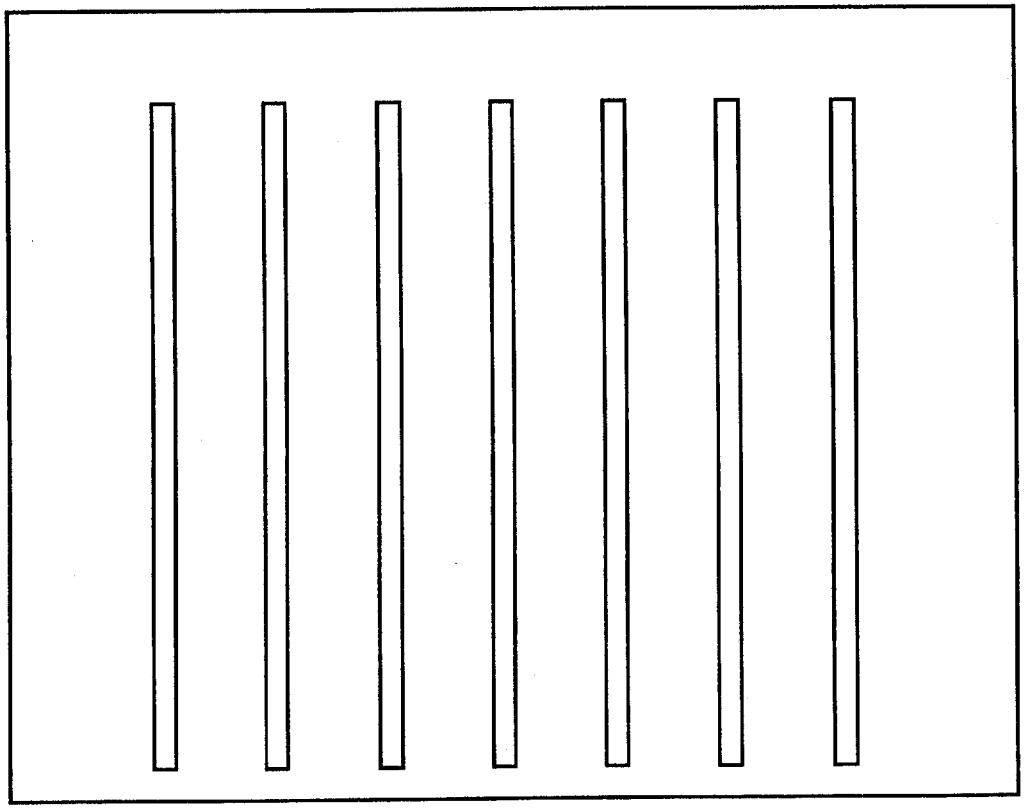
FIG. 13 illustrates a pattern of an exposure mask for the PDP of the sixth exemplary embodiment.

It was coated with photo-resist, OFPR-800 (a product of Tokyo Ohka Kogyo Co., Ltd.), by spin coating and dried (at 80° C.). It was then exposed through an exposure mask having a pattern shown in FIG. 13, and developed with developer NMD-3 (also a product of Tokyo Ohka Kogyo Co., Ltd.). Further, it was put into etching solution (nitric-acid aqueous solution) for etching the dielectric layer, rinsed with water, washed with acetone, and dried thoroughly. Then, a protective layer was formed by depositing protective layer material of MgO over the dielectric layer with a vacuum evaporation method.

The PDP was manufactured by arranging face to face the front plate produced in the foregoing process and the back plate, sealing a periphery of them with frit glass, and charging it with gas (a mixture of Ne gas with 5% Xe, at a pressure of 500 torr) after sufficient evacuation of air.

A display device employing the PDP of this exemplary embodiment was illuminated in its entire screen, and a voltage imposed between the pair of display electrodes 41 and 42, and a current was observed. Then, a V–Q Lissajous' figure was obtained by plotting the voltage (V) and an electric charge (Q) derived by integrating the current with time, on the axis of abscissas and the axis of ordinates respectively. A capacitance of the PDP can be obtained from a gradient of the V–Q Lissajous' figure in a pause period of discharge. An evaluation of ineffectual power was made for power consumption during the pause period of discharge.

A result of the foregoing evaluation has shown that the structure, in which a portion 15 of the inner surface of the substrate 10 is opened to the discharge space through the protective layer 12, lowers power consumption as shown in Table 3, thereby the structure can reduce the ineffectual power.

Figure 14:
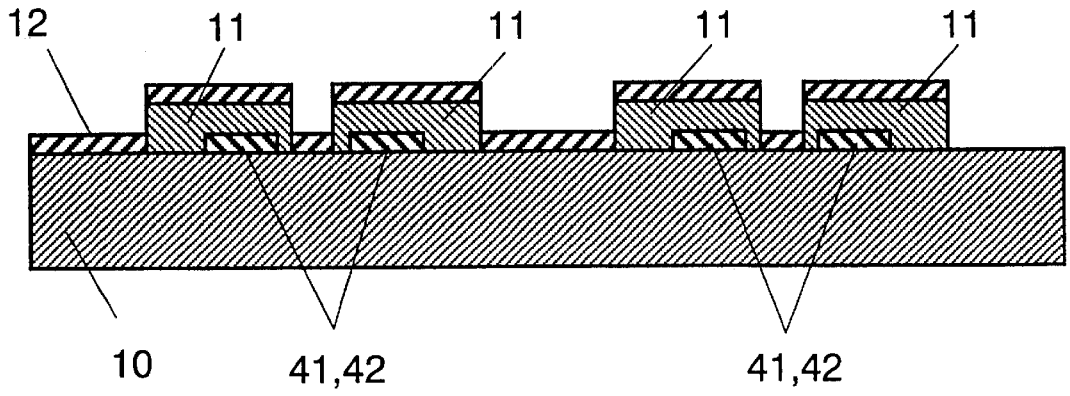
FIG. 14 is a cross-sectional view depicting a front plate of another PDP of the sixth exemplary embodiment.

In addition, it is possible to produce a front plate having a structure as depicted in a cross-sectional view of FIG. 14, for instance, by altering the etching pattern. A PDP employing the above front plate is also capable of reducing the ineffectual power.

As has been obvious from the above exemplary embodiment, the present invention can lower capacitance of a ineffectual capacitor not contributing to the discharge, so as to effectively reduce ineffectual power of a surface-discharge type PDP. In which at least a pair of display electrodes 41 and 42 are formed directly on an inner surface of a substrate 10, and a dielectric layer 11 and a protective layer 12 are formed over them, and a portion 15 of the inner surface of the substrate 10 is opened to the discharge space through the protective layer 12. Since an area filled with dielectric body in the conventional structure is replaced by the discharge space of low dielectric constant in the PDP produced as above.

Seventh Exemplary Embodiment

Figure 15A:
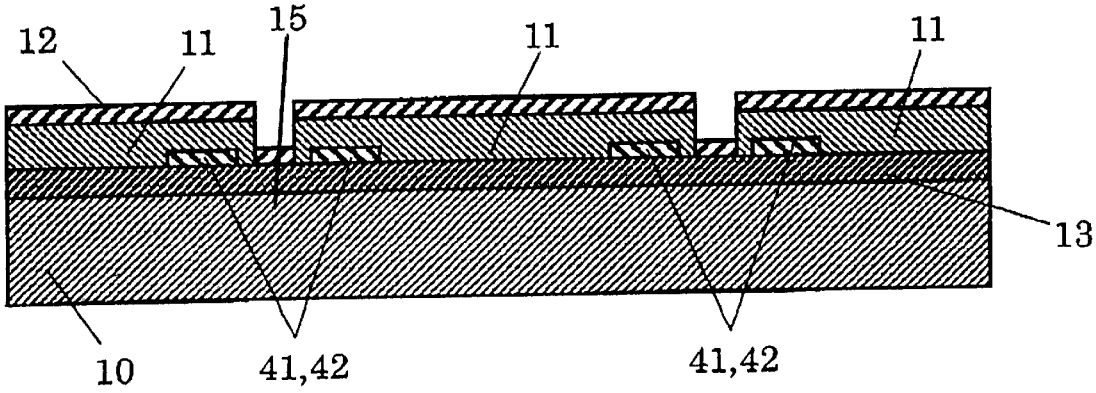
FIG. 15A is a cross-sectional view depicting a front plate of PDP of a seventh exemplary embodiment of the present invention.

FIG. 15 is a typical cross-sectional view depicting a front plate of a PDP of a seventh exemplary embodiment of the present invention.

In the PDP of FIG. 15, an underlying layer 13 is formed on an inner surface of a substrate 10 out of a pair of substrates, which sandwich a discharge space between them, in generally parallel to the substrate surface. A pair of display electrodes 41 and 42 are formed on the underlying layer 13, and a dielectric layer 11 and a protective layer 12 are formed on them one after another. As a result, a portion 15 of the inner surface of the substrate 10 is opened to the discharge space through the underlying layer 13 and the protective layer 12. The portion 15 is in a striped pattern, and it lies between the display electrodes 41 and 42 in generally parallel with them.

A manufacturing process of the PDP of this exemplary embodiment will be described next. The manufacturing process of the PDP of this exemplary embodiment is same as that of the first exemplary embodiment except for a manufacturing process of the front plate.

A manufacturing process of the front plate is described hereinafter. A substrate 10 used here was a soda lime glass plate in a thickness of 2.8 mm. An underlying layer 13 of $SiO_2$ was formed approximately uniformly on the substrate with a vacuum-evaporation method. Then, display electrodes were formed by depositing chromium, copper and chromium in this order with a vacuum-evaporation method. Further, a dielectric layer was formed by screen-printing dielectric paste, G3-0496, followed by drying (at 150° C.), and firing (at 580° C.). It was coated next with photo-resist, OFPR-800, by spin-coating and dried (at 80° C.), followed thereafter by an exposure through an exposure mask having a pattern shown in FIG. 13, and a development with developer NMD-3. Furthermore, it was put into etching fluid (nitric-acid aqueous solution) for etching the dielectric layer, rinsed with water, washed with acetone, and dried thoroughly. Finally, a protective layer was formed by depositing MgO over the dielectric layer with a vacuum-evaporation method.

A display device in the present exemplary embodiment will be described now. A display device in this exemplary embodiment is identical to the display device in the sixth exemplary embodiment, except that it employs a PDP of this exemplary embodiment.

Figure 15B:
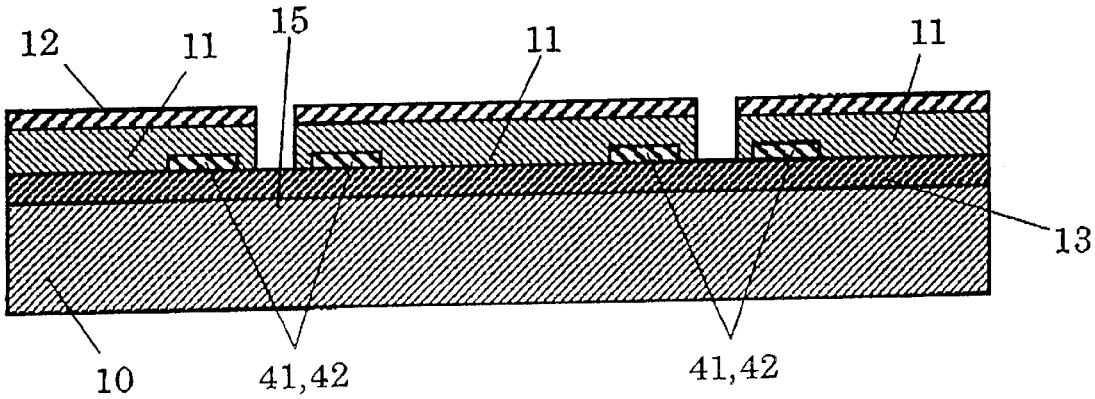
FIG. 15B is a cross-sectional view depicting a front plate of a PDP of the seventh exemplary embodiment of the present invention.

The foregoing display device has been illuminated in its entire screen, and ineffectual power was evaluated in the same manner as the sixth exemplary embodiment. A result of the evaluation has revealed that power consumption is lowered as shown in Table 3 and ineffectual power can be reduced with the structure, in which the underlying layer 13 is formed with material of low dielectric constant, and the portion 15 of the inner surface of the substrate 10 is opened to the discharge space through the underlying layer 13 and the protective layer 12. The same result is obtained when the portion 15 is opened to the discharge space via the underlying layer 13 as shown in FIG. 15B.

Eighth Exemplary Embodiment

Figure 16:
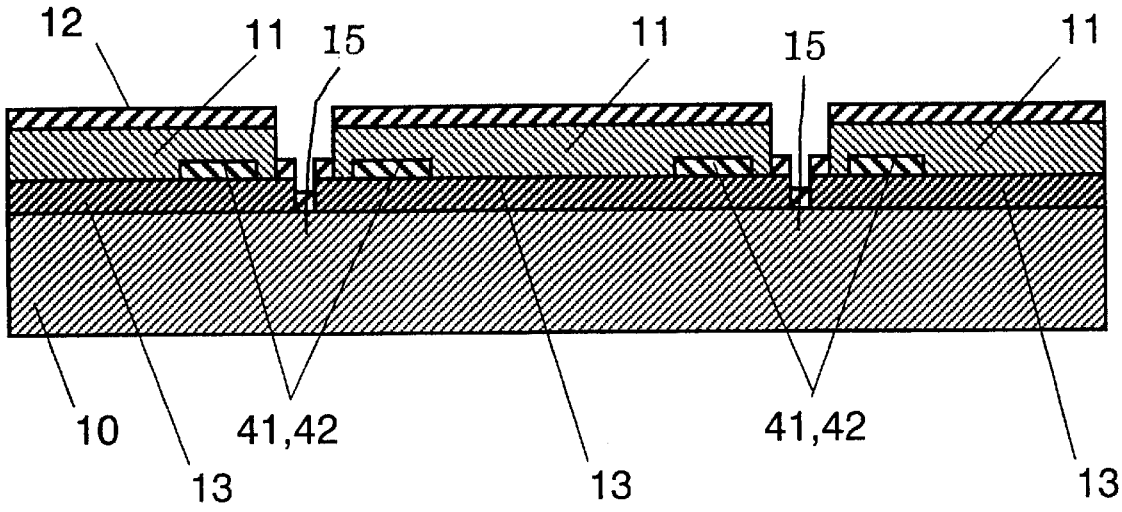
FIG. 16 is a cross-sectional view depicting a front plate of a PDP of an eighth exemplary embodiment of the present invention.

FIG. 16 is a typical cross-sectional view depicting a front plate of a PDP of an eighth exemplary embodiment of the present invention.

In the PDP of FIG. 16, an underlying layer 13 is formed on an inner surface of a substrate 10 in generally parallel to the substrate surface, a pair of display electrodes 41 and 42 are formed directly on top of it, and a dielectric layer 11 and a protective layer 12 are formed on them one after another. In addition, a portion 15 of the inner surface of the substrate 10 is opened to a discharge space through the protective layer 12. The portion 15 of the inner surface of the substrate 10 opened to the discharge space through the protective layer 12 is in a striped pattern, and it lies between the display electrodes 41 and 42 in generally parallel with them.

A manufacturing process of the PDP of this exemplary embodiment will be described next. The manufacturing process of the PDP of this exemplary embodiment is also same as that of the first exemplary embodiment except for a manufacturing process of the front plate.

The manufacturing process of the front plate is described hereinafter. A substrate 10 used here was a soda lime glass plate in a thickness of 2.8 mm. An underlying layer of $SiO_2$ was formed approximately uniformly on the substrate with a vacuum-evaporation method. Then, display electrodes were formed successively on the underlying layer by depositing chromium, copper and chromium in this order with a vacuum-evaporation method. Further, a dielectric layer was formed by screen-printing dielectric paste, G3-0496, followed by drying (at 150° C.), and firing (at 580° C.). It was coated next with photo-resist, OFPR-800, by spin-coating and dried (at 80), followed thereafter by an exposure through an exposure mask having a pattern shown in FIG. 13, and a development with developer NMD-3. Subsequently, it was put into etching solution(nitric-acid aqueous solution and fluoric-acid aqueous solution) for etching the dielectric layer an the underlying layer, rinsed with water, washed with acetone, and dried thoroughly. Finally, a protective layer was formed by depositing of MgO over the dielectric layer with a vacuum-evaporation method.

A display device employing a PDP of this exemplary embodiment was illuminated in its entire screen, and ineffectual power was evaluated. A result of the evaluation has revealed that power consumption is lowered even farther as shown in Table 3 and ineffectual power can be reduced with the structure, in which the underlying layer 13 is formed with material of low dielectric constant, and the portion 15 of the inner surface of the substrate 10 is opened to the discharge space through the protective layer 12.

Ninth Exemplary Embodiment

Figure 17:
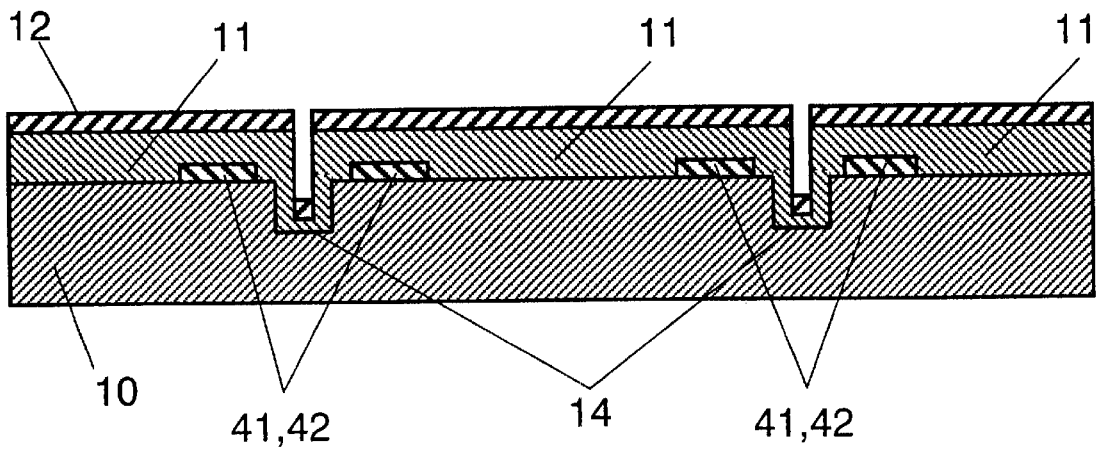
FIG. 17 is a cross-sectional view depicting a front plate of a PDP of a ninth exemplary embodiment of the present invention.

FIG. 17 is a typical cross-sectional view depicting a front plate of a PDP of a ninth exemplary embodiment of the present invention.

In the PDP of FIG. 17, a pair of display electrodes 41 and 42 are formed directly on an inner surface of a substrate 10, and a dielectric layer 11 and a protective layer 12 are formed on them one after another. In addition, a groove 14 is formed in a portion 15 of the inner surface of the substrate 10. The afore-said groove 14 is in a striped pattern, and it lies between the display electrodes 41 and 42 in generally parallel with them.

A manufacturing process of the PDP of this exemplary embodiment will be described next. The manufacturing process of the PDP of this exemplary embodiment is also same as that of the first exemplary embodiment except for a manufacturing process of the front plate.

The manufacturing process of the front plate is described hereinafter. A substrate 10 used here was a soda lime glass plate in a thickness of 2.8 mm. A groove was formed on the substrate with etching, sand-blasting, or the like method, and display electrodes were formed in parallel to the groove by depositing chromium, copper and chromium in this order with a vacuum-evaporation method. Further, a dielectric layer was formed by screen-printing dielectric paste, G3-0496, followed by drying (at 150° C.), and firing (at 580° C.). Finally, a protective layer was formed by depositing MgO over the dielectric layer with a vacuum-evaporation method.

A display device employing a PDP of this exemplary embodiment was illuminated in its entire screen, and ineffectual power was evaluated. A result of the evaluation has revealed that power consumption is lowered as shown in Table 3, and ineffectual power can be reduced with the structure, in which the groove 14 is formed in the portion 15 on the inner surface of the substrate 10.

As has been obvious from the present exemplary embodiment, the present invention can effectively reduce ineffectual power of a PDP, which uses the substrate 10 with the groove 14 formed in the portion 15.

Tenth Exemplary Embodiment

Figure 18A:
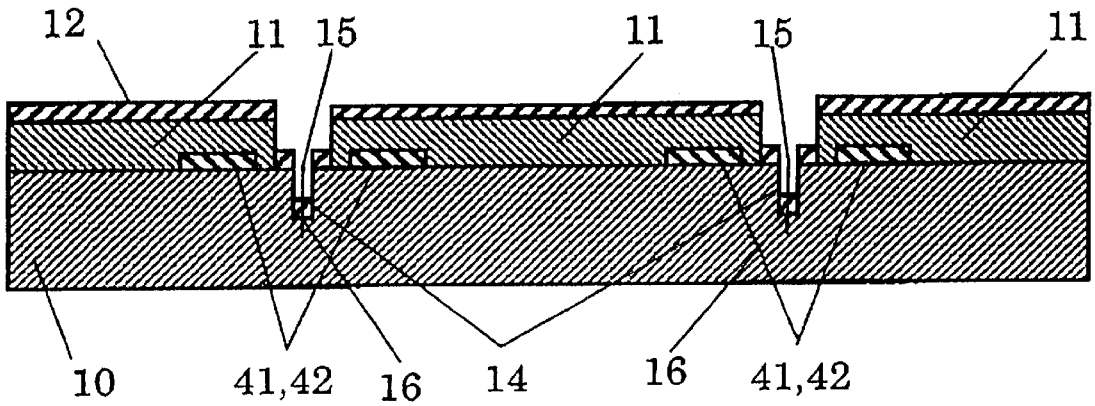
FIG. 18A is a cross-sectional view depicting a front plate of a PDP of a tenth exemplary embodiment of the present invention.

FIG. 18A is a typical cross-sectional view depicting a front plate of a PDP of a tenth exemplary embodiment of the present invention. In the PDP of FIG. 18A, a pair of display electrodes 41 and 42 are formed directly on an inner surface of a substrate 10, and a dielectric layer 11 and a protective layer 12 are formed on them one after another. In addition, a portion 15 of the inner surface of the substrate 10 is formed with a groove 14, and a bottom surface 16 of the groove 14 is opened to a discharge space via the protective layer 12. The afore-said groove 14 is in a striped pattern, and it lies between the display electrodes 41 and 42 in generally parallel with them.

A manufacturing process of the PDP of this exemplary embodiment will be described next. The manufacturing process of the PDP of this exemplary embodiment is also same as that of the first exemplary embodiment except for a manufacturing process of the front plate.

The manufacturing process of the front plate is as follows. A substrate 10 used here was a soda lime glass plate in a thickness of 2.8 mm. A groove was formed on the substrate, and a front plate was completed in the same manner as the sixth exemplary embodiment.

A display device employing a PDP of this exemplary embodiment was illuminated in its entire screen, and ineffectual power was evaluated. A result of the evaluation has revealed that power consumption is lowered as shown in Table 3, and ineffectual power can be reduced with the structure, in which the groove 14 is formed in the portion 15, and the bottom surface 16 of the groove 14 is opened to the discharge space via the protective layer 12.

As has been obvious from the present exemplary embodiment, the present invention can effectively reduce ineffectual power of a PDP, which is produced with the substrate 10 having the groove 14 in the portion 15 of its inner surface, and the bottom surface 16 of the groove 14 being opened to the discharge space directly or through the protective layer 12.

Eleventh Exemplary Embodiment

Figure 19:
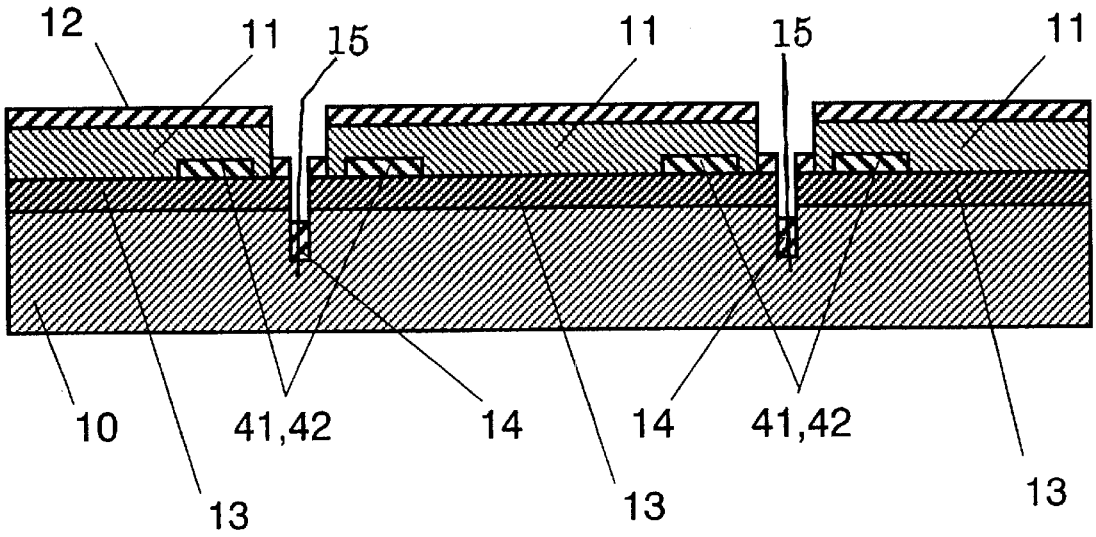

FIG. 19 is a typical cross-sectional view depicting a front plate of a PDP of an eleventh exemplary embodiment of the present invention.

In the PDP of FIG. 19, at least an underlying layer 13 is formed on an inner surface of a substrate 10 in generally parallel to the substrate surface. A pair of display electrodes 41 and 42 are formed directly on top of the underlying layer 13, and a dielectric layer 11 and a protective layer 12 are formed on them one after another. The substrate 10 has a groove 14 in a portion 15 of its inner surface, and a bottom surface 16 of the groove 14 is opened to a discharge space through the underlying layer 13 and the protective layer 12. The afore-said groove 14 is in a striped pattern, and it lies between the display electrodes 41 and 42 in generally parallel with them.

A manufacturing process of the PDP of this exemplary embodiment will be described next. The manufacturing process of the PDP of this exemplary embodiment is also same as that of the first exemplary embodiment except for a manufacturing process of the front plate.

The manufacturing process of the front plate is as follows. A substrate 10 used here was a soda lime glass plate in a thickness of 2.8 mm. A groove was formed on the substrate, and a front plate was produced in the same manner as the seventh exemplary embodiment.

A display device in the present exemplary embodiment will be described now. A display device in this exemplary embodiment is identical to the display device in the first exemplary embodiment, except that it employs a PDP of this exemplary embodiment.

The display device employing the PDP of this exemplary embodiment was illuminated in its entire screen, and ineffectual power was evaluated. A result of the evaluation has revealed that power consumption is lowered as shown in Table 3, and ineffectual power can be reduced with the structure, in which the groove 14 is formed in the portion 15, and the bottom surface 16 of the groove 14 is opened to the discharge space through the underlying layer 13 and the protective layer 12.

As has been obvious from the present exemplary embodiment, the present invention can effectively reduce ineffectual power of the PDP, in which the substrate 10 has the groove 14 in the portion 15 of its inner surface, and the bottom surface 16 of the groove 14 is opened to the discharge space through the underlying layer 13 or through the underlying layer 13 and the protective layer 12.

TABLE 3

Figure 30:
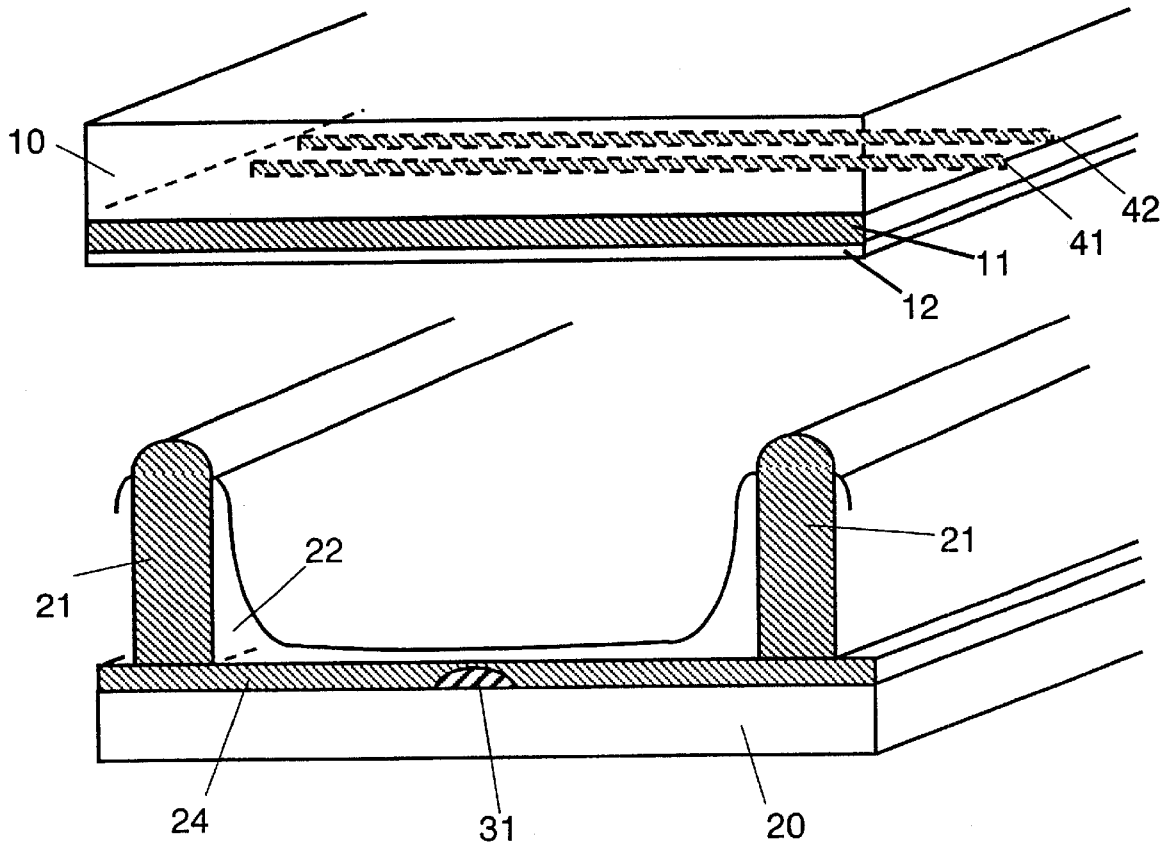
FIG. 30 Prior Art
FIG. 30 is an exploded perspective view depicting a surface-discharge type PDP having a 3-electrode structure of the prior art.
Figure 31:
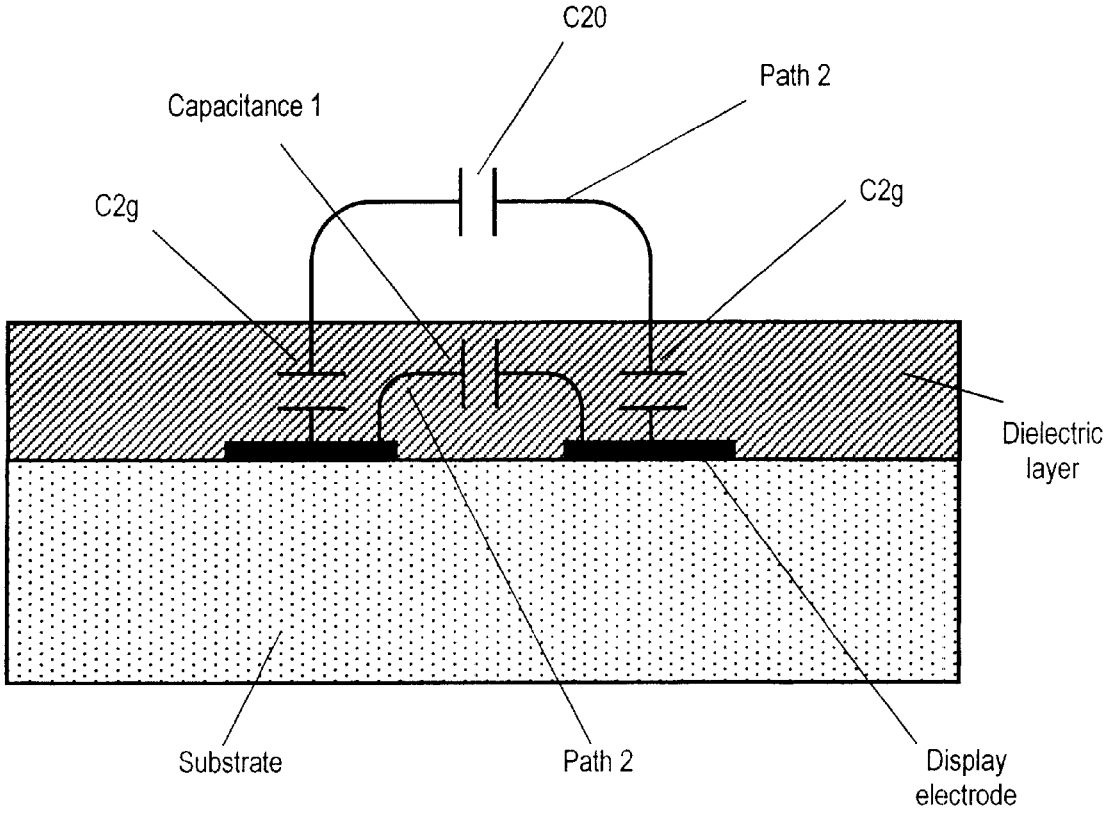
FIG. 31 Prior Art
FIG. 31 is a drawing depicting electric paths in the surface-discharge type PDP of the prior art.

| Structure of PDP | Comparison of Power consumption |
|---|---|
| The prior art (FIG. 30) | 100 |
| Sixth exemplary embodiment (FIG. 12) | 70 |
| Sixth exemplary embodiment (FIG. 14) | 65 |
| Seventh exemplary embodiment (FIG. 15) | 60 |

TABLE 3-continued

Figure 18B:
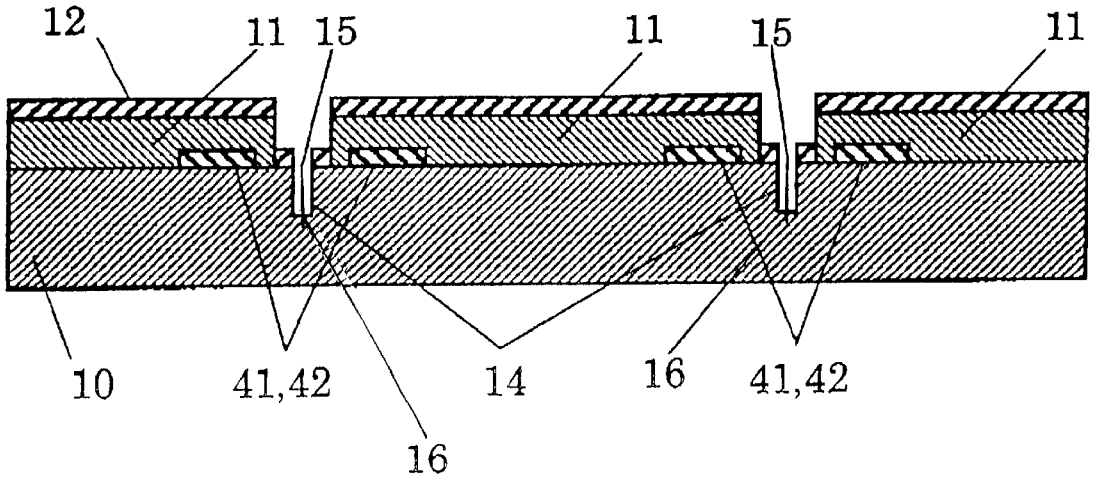
FIG. 18B is a cross-sectional view depicting another front plate of a PDP of the tenth exemplary embodiment of the present invention.

| Structure of PDP | Comparison of Power consumption |
|---|---|
| Eighth exemplary embodiment (FIG. 16) | 50 |
| Ninth exemplary embodiment (FIG. 17) | 55 |
| Tenth exemplary embodiment (FIG. 18) | 50 |
| Eleventh exemplary embodiment (FIG. 19) | 45 |

Twelfth Exemplary Embodiment

An exemplary embodiment of the present invention will be described hereinafter with reference to the accompanied figures.

A PDP of the present exemplary embodiment has protrusions 23 formed lower than barrier ribs 21 on an inner surface of a substrate 20 representing a back plate. And phosphor layers 22 are formed on rib surfaces in EU's of the substrate 20 including surfaces of the protrusions 23, wherein a luminous balance of individual colors (red, green and blue) of the phosphor layers 22 is controlled by shape of the protrusions 23.

Figure 20:
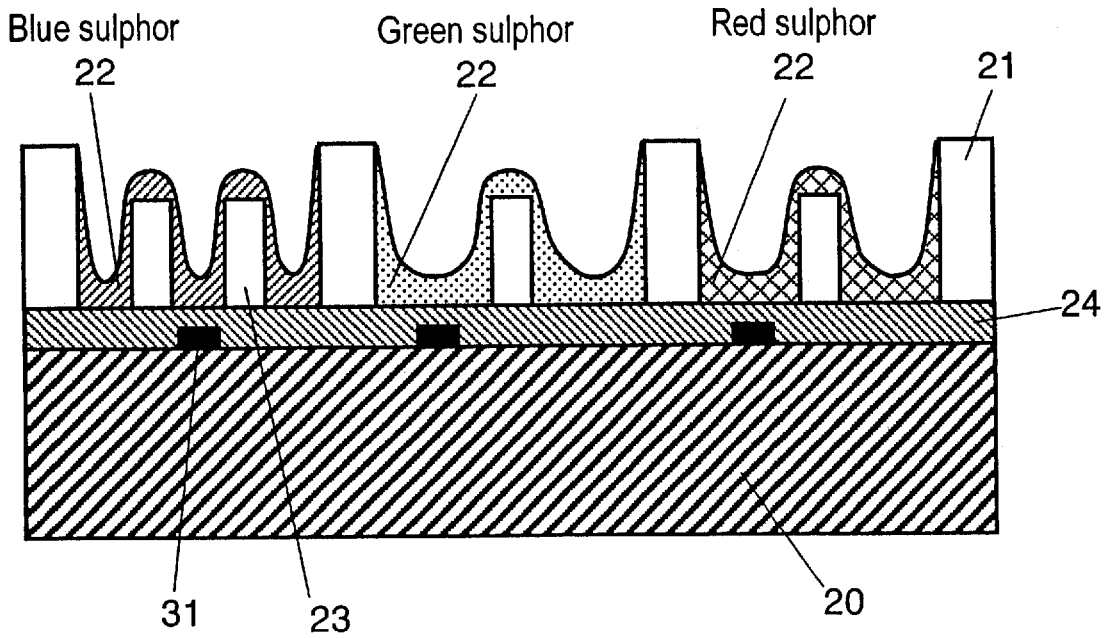
FIG. 20 is a cross-sectional view depicting a back plate of a PDP of a twelfth exemplary embodiment of the present invention.
Figure 21:
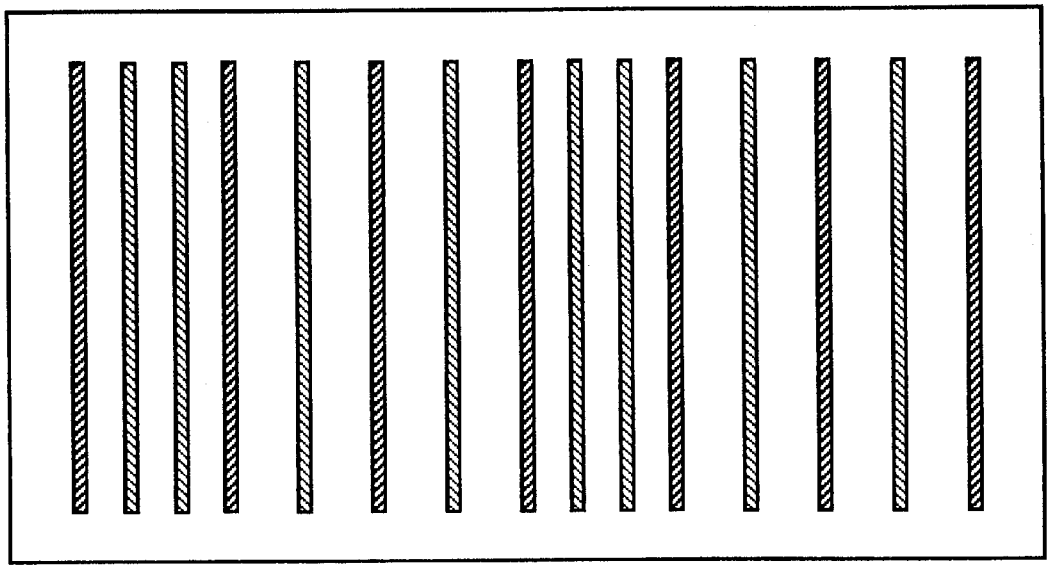
FIG. 21 illustrates a printing pattern of barrier ribs and protrusions of the PDP of the twelfth exemplary embodiment of the present invention.
Figure 22:
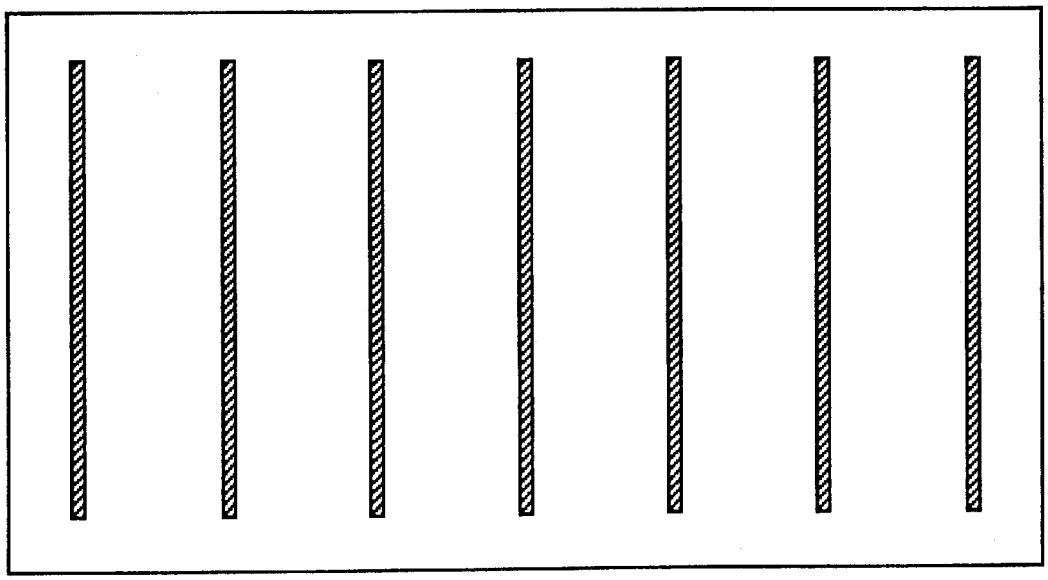
FIG. 22 illustrates a printing pattern of barrier ribs of the PDP of the twelfth exemplary embodiment of the present invention.

The present exemplary embodiment will be described hereinafter concretely with reference to an example of the back plate of a PDP shown in FIG. 20. In the PDP of FIG. 20, the barrier ribs 21 are formed in a striped pattern, and the protrusions 23, also in a striped pattern, are provided generally in parallel with the barrier ribs 21. Two lines of the protrusions 23 are provided in each of blue cells, and an address electrode 31 is provided in a middle position between the two lines of protrusions 23 in generally parallel to the protrusions 23. A line of protrusion 23 is provided in each of the other color cells, and an address electrode 31 is provided in a middle position between the protrusion 23 and the barrier rib in generally parallel to the protrusion 23. An overcoating layer 24 of dielectric material is formed over the address electrodes 31. The phosphor layers 22 are formed over an entire rib of each cell, including a surface of the protrusions 23.

A manufacturing process of the PDP of this exemplary embodiment is same as that of the first exemplary embodiment except that a number of the protrusions 23 vary depending on color of the phosphor.

An evaluation was conducted on a display device employing the PDP of the present exemplary embodiment for brightness and luminous efficiency by illuminating its screen entirely. A result has shown an improvement of approximately 30% in both of brightness and luminous efficiency as well as an increasing of approximately 30% also in color temperature as compared to the display device of the prior art having a structure shown in FIG. 30.

As has been obvious from the present exemplary embodiment, the invention can display white color of high color temperature, since a balance of each color can be controlled freely by maintaining the control of the balance of each color (red, green and blue) of the phosphor layers 22 with shape of the protrusions 23.

Thirteenth Exemplary Embodiment

Figure 23:
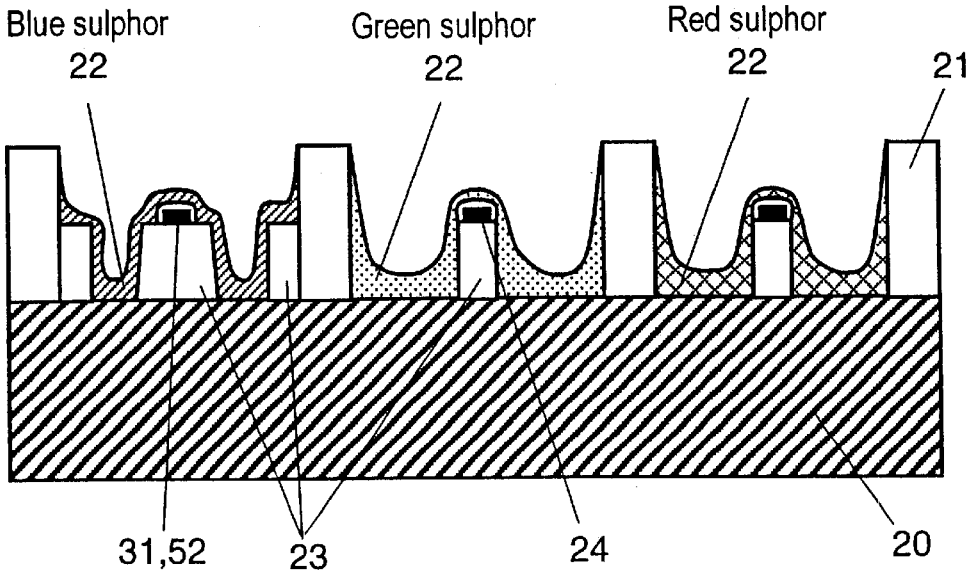
FIG. 23 is a cross-sectional view depicting a back plate of a PDP of a thirteenth exemplary embodiment of the present invention.

FIG. 23 is a typical cross-sectional view depicting a back plate of a PDP of the present exemplary embodiment.

In the PDP of FIG. 23, barrier ribs 21 are formed in a striped pattern, and the protrusions 23, also in a striped pattern, are provided generally in parallel with the barrier ribs 21. Each of blue cells is provided with three lines of the protrusions 23, of which a center protrusion is formed in a width larger than the other two, and the other two are formed in contact with the barrier ribs. An address electrode 31 is provided on an upper part of the center protrusion 23, and an overcoating layer is formed on it. A line of protrusion 23 is provided in each of the other color cells, an address electrode 31 is provided on an upper part of the protrusion 23, and an overcoating layer is formed over it. A phosphor layer 22 is formed over an entire rib of each cell, including surface of the protrusions 23. A structure of a front plate is identical to that of the first exemplary embodiment.

Figure 24:
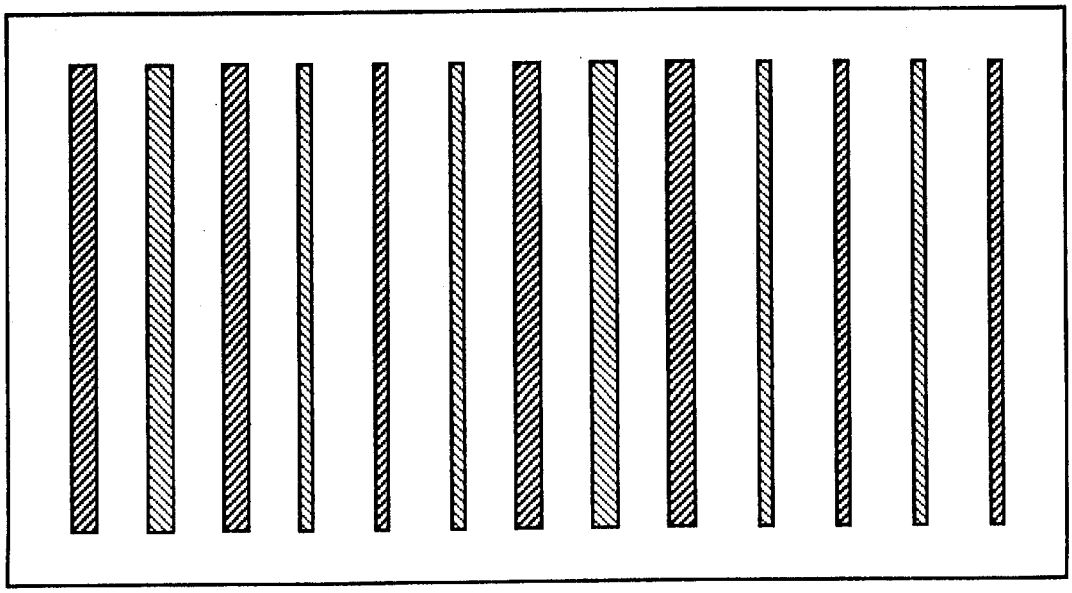
FIG. 24 illustrates a printing pattern of barrier ribs and protrusions of the PDP of the thirteenth exemplary embodiment of the present invention.

A manufacturing process of the back plate will be described hereinafter. The manufacturing process is same as that of the second exemplary embodiment, except that the barrier ribs and the protrusions are formed in a predetermined height on the substrate with a screen mask having a pattern shown in FIG. 24.

An evaluation was conducted on a display device of the afore-described structure for brightness and luminous efficiency by illuminating its screen entirely. A result has shown an improvement of approximately 30% in both of brightness and luminous efficiency as well as an increasing of approximately 30% in color temperature as compared to the display device of the prior art having a structure shown in FIG. 30. An address characteristic was also favorable.

Fourteenth Exemplary Embodiment

Figure 25:
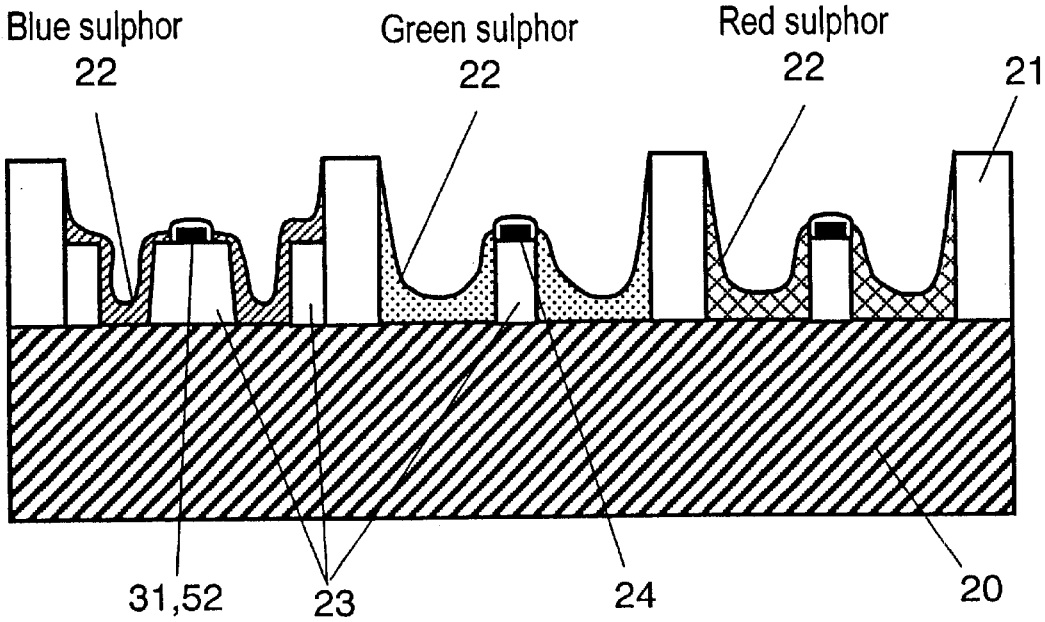
FIG. 25 is a cross-sectional view depicting a back plate of a PDP of a fourteenth exemplary embodiment of the present invention.

FIG. 25 is a typical cross-sectional view depicting a back plate of a PDP of the present exemplary embodiment.

A luminous balance of individual colors (red, green and blue) of the phosphor layers 22 is controlled by shape of the protrusions 23. Also, the protrusions are formed in contact with the barrier ribs in a cell covered with a blue phosphor layer. A structure of the back plate in this exemplary embodiment is identical to that of the thirteenth exemplary embodiment, except that the phosphor layer is not formed on top of the address electrode.

An evaluation was conducted on a display device employing the PDP of the present exemplary embodiment for brightness and luminous efficiency by illuminating its screen entirely. A result has shown an improvement of approximately 30% in both of brightness and luminous efficiency as well as an increasing of approximately 30% in color temperature as compared to the display device of the prior art having a structure shown in FIG. 30. An address characteristic was also favorable. In addition, degradation of the phosphor layer was reduced.

Fifteenth Exemplary Embodiment

A PDP of the present exemplary embodiment employs a back plate, of which cross-sectional view is shown in FIG. 23, and a front plate shown in FIG. 11. It is identical to the PDP of the thirteenth exemplary embodiment except for the front plate. A display device in this exemplary embodiment operates in the same manner as that of the fourth exemplary embodiment.

An evaluation was conducted on the display device in the present exemplary embodiment for brightness and luminous efficiency by illuminating its screen entirely. A result has shown an improvement of approximately 30% in both of brightness and luminous efficiency as well as an improvement of approximately 30% in color temperature as compared to the display device of the prior art having a structure shown in FIG. 30.

Sixteenth Exemplary Embodiment

A PDP of the present exemplary embodiment employs a PDP of the fifteenth exemplary embodiment with the back plate replaced by one shown in FIG. 25.

An evaluation was conducted on a display device in the present exemplary embodiment for brightness and luminous efficiency by illuminating its screen entirely. A result has shown an improvement of approximately 30% in both of brightness and luminous efficiency as well as an increasing of approximately 30% in color temperature as compared to the display device of the prior art having a structure shown in FIG. 30. An address characteristic was favorable and degradation of the phosphor layer was also reduced with the display device in this exemplary embodiment.

Seventeenth Exemplary Embodiment

Figure 26:
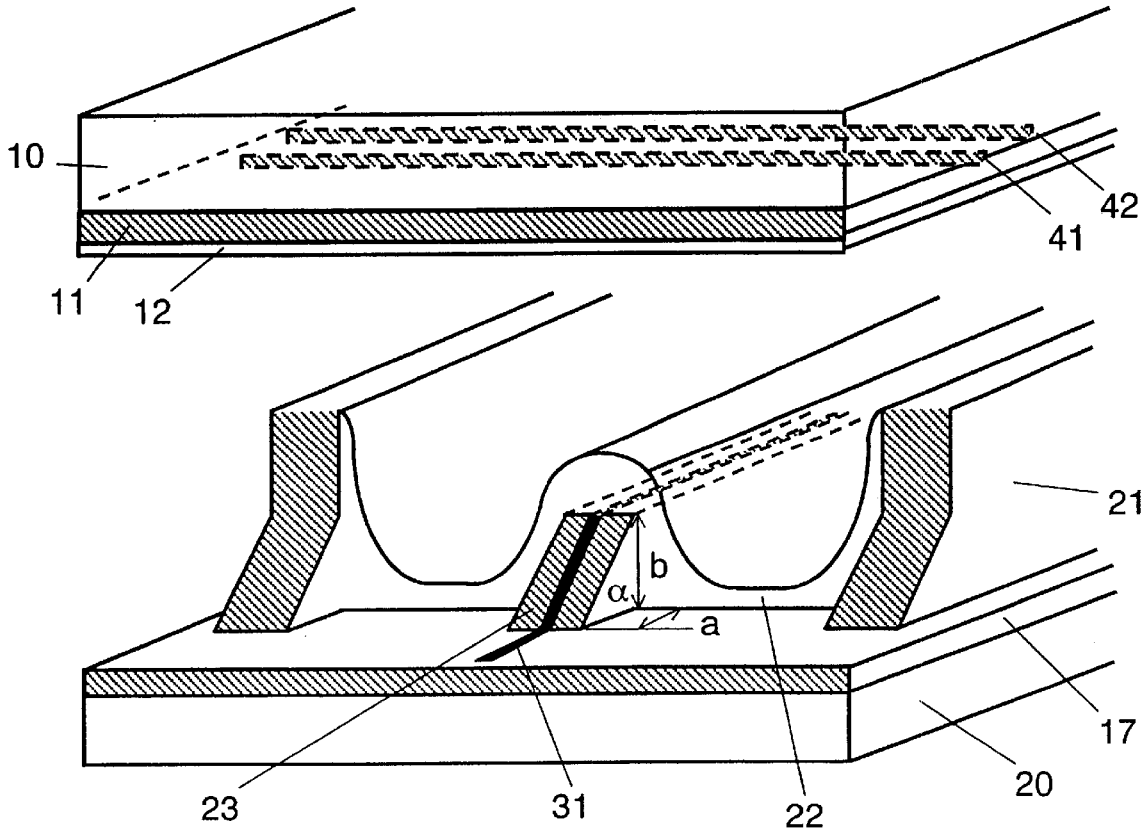
FIG. 26 is an exploded perspective view depicting a PDP of a seventeenth exemplary embodiment.

FIG. 26 is a typical cross-sectional view depicting a PDP of the present exemplary embodiment.

The PDP of this exemplary embodiment is provided with a pair of display electrodes 41 and 42 on an inner surface of a substrate 10, and barrier ribs 21 in a striped shape for dividing into individual EU's and a phosphor layer 22 on an inner surface of another substrate 20. A protrusion 23 lower than the barrier ribs is provided in parallel with the barrier ribs on the inner surface of the substrate 20, and an address electrode 31 is provided on an upper part of the protrusion.

In the PDP of this exemplary embodiment, a reflection layer 17 is formed on the substrate 20, and the barrier ribs 21 are formed over it in the striped shape. The protrusion 23 is also formed in the striped shape in parallel with the barrier ribs 21, and an inclination angle "α" of a sloped surface at a end in a longitudinal direction of the protrusion is 30° or less. The address electrode 31 is formed on an upper part of the protrusion. The phosphor layer 22 is formed between the two adjacent barrier ribs in a manner to cover the protrusion. A structure of a front plate is identical to that of the first exemplary embodiment.

Figure 27:
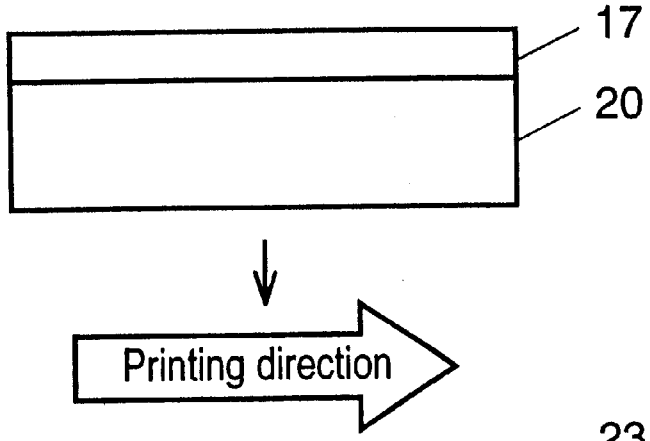
FIG. 27 is a drawing depicting typical steps of forming a protrusion of the seventeenth exemplary embodiment.
Figure 27:
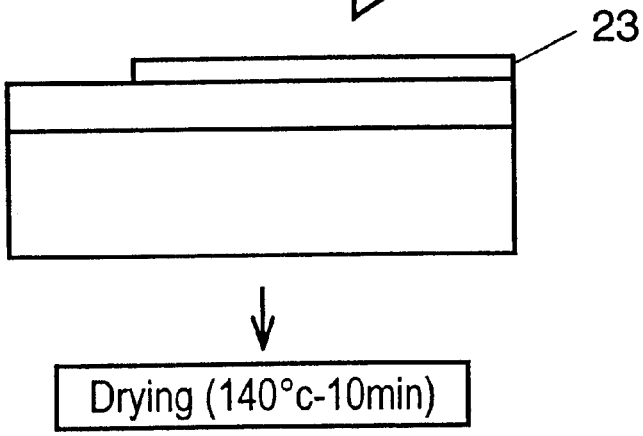
Figure 27:
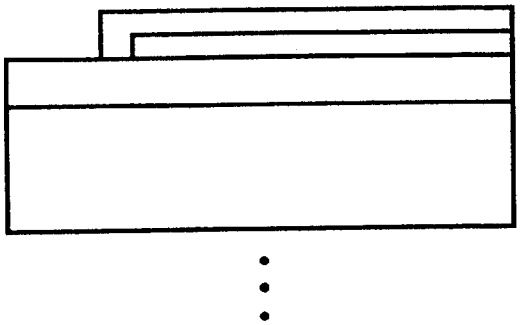
Figure 27:
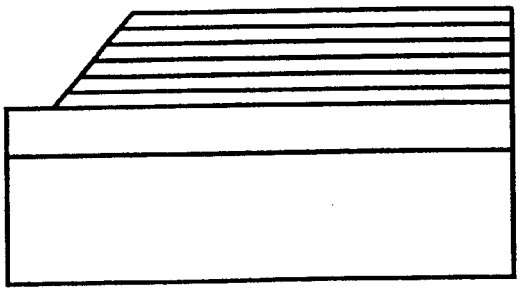

A manufacturing process of the protrusion of this exemplary embodiment will be described next. FIG. 27 is a typical drawing showing manufacturing steps for forming a protrusion by screen printing, wherein (a) through (d) in FIG. 27 are cross-sectional views illustrating the back plate in the individual manufacturing steps. First, paste is screen-printed in a height necessary for the protrusion on the back plate substrate 20 covered by the reflection layer 17, by using a screen mask that is able to form both barrier ribs and a protrusion at once, as shown in FIG. 27(*b*).

During this process, the screen mask is shifted at regular intervals to a direction opposite to a printing direction after every printing of single layer, as shown in FIG. 27(*b*) to FIG. 27(*c*) This printing step is repeated again and again. Also, the paste is dried (at 140° C. for 10 min.) every time after the printing is made. The sloped surface can be formed easily and precisely at the end in the longitudinal direction of the protrusion by the above method. The protrusion 23 having the sloped surface at its end and the barrier ribs 21 are formed by repeating the foregoing printing process.

Next, the address electrode 19 is formed by printing silver paste on an upper part of the protrusion with screen-printing, followed by drying and firing. An ordinary printing method can be used without requiring any alteration for forming the address electrode on the protrusion, including the sloped surface.

A study was made to determine an upper limit of the inclination angle "α" of the sloped surface at the end in the longitudinal direction of the protrusion, in order to ensure a reliable printing and connection of the address electrode. A shape of the sloped surface can be in a form of steps, and it needs not be a flat surface, as the inclination angle "α" has been calculated from a proportion of a height of the protrusion to a length of bottom side corresponding to the slope. The address electrode may be disconnected at a boundary between the substrate or the reflection layer and the proportion, if the inclination angle "α" of the sloped surface at the end in the longitudinal direction of the protrusion is too steep. A result of the study is shown in Table 4. As has been obvious from the result, the ordinary method of forming the address electrode can be used without making any alteration, if the inclination angle "α" is 30° C. or less, thereby the address electrode can be formed easily and precisely without resulting in a disconnection.

TABLE 4

| Angle of inclination α (°) | Address electrode printability |
|---|---|
| 3.0 | ○ |
| 10.0 | ○ |
| 20.0 | ○ |
| 30.0 | ○ |
| 31.1 | x |

Eighteenth Exemplary Embodiment

Figure 28:
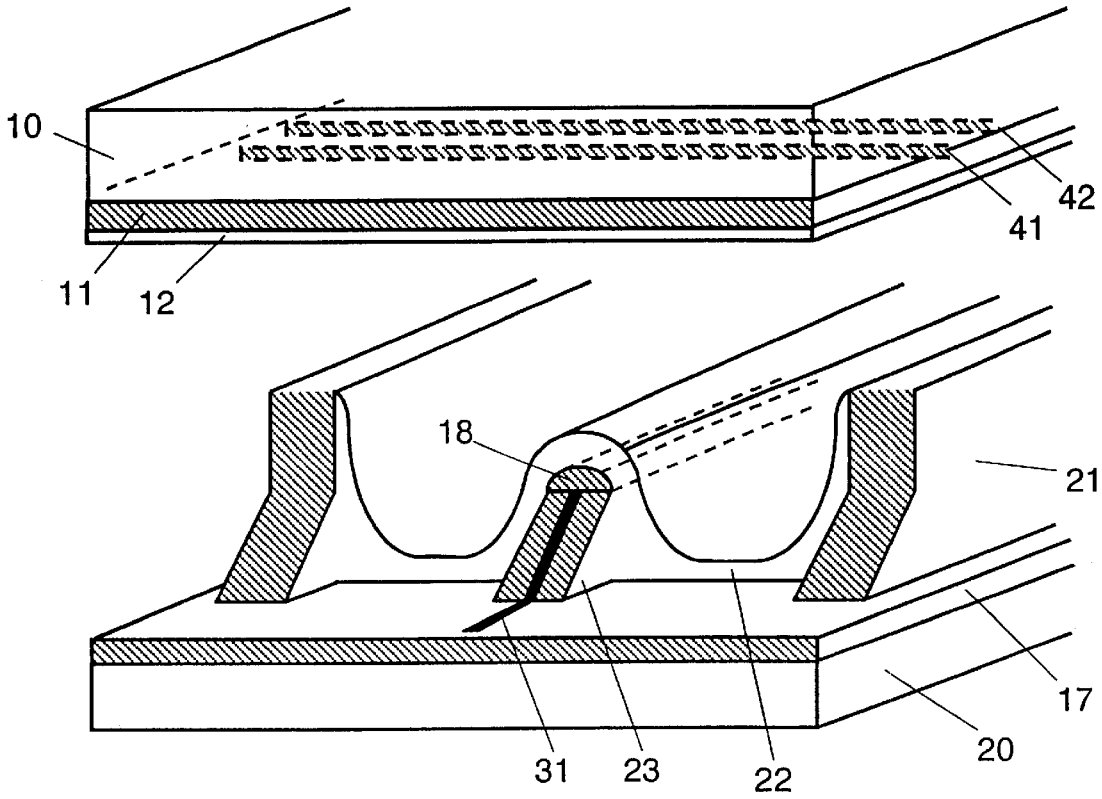
FIG. 28 is an exploded perspective view depicting a PDP of an eighteenth exemplary embodiment.

FIG. 28 is a typical cross-sectional view depicting a PDP of an eighteenth exemplary embodiment.

The PDP of FIG. 28 has a structure, in which a white overcoating 18 in a form of striped pattern is formed in a manner to cover the address electrode 31 in the structure of the seventeenth exemplary embodiment. A phosphor layer 22 is formed between two adjacent barrier ribs in a manner to cover a protrusion.

Next, a concrete manufacturing process for the PDP of this exemplary embodiment of the invention will be described. A manufacturing process of a front plate is same as that of the first exemplary embodiment.

Figure 29:
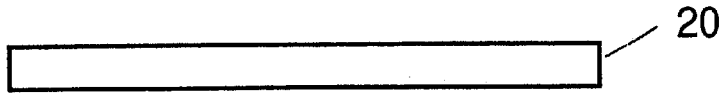
FIG. 29 is a drawing depicting manufacturing steps of a back plate.
Figure 29:
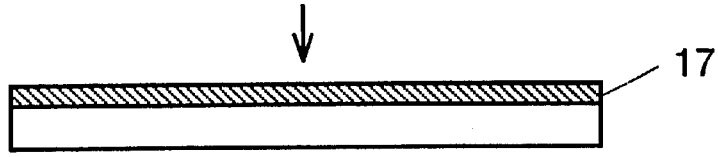
Figure 29:
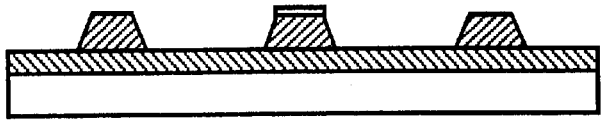
Figure 29:
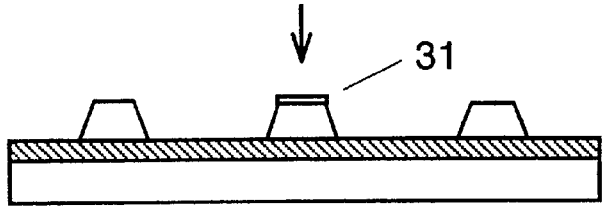
Figure 29:
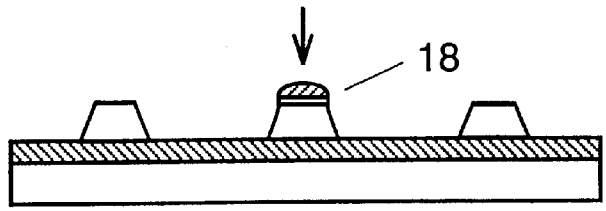
Figure 29:
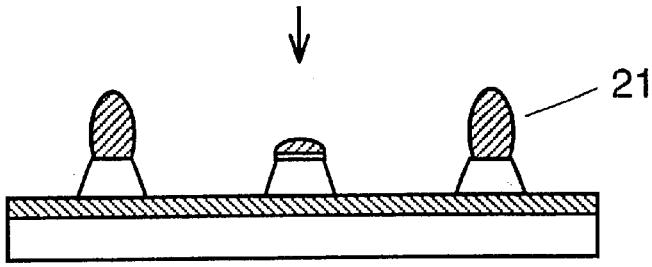
Figure 29:
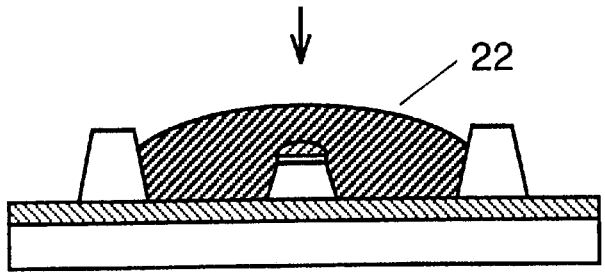
Figure 29:
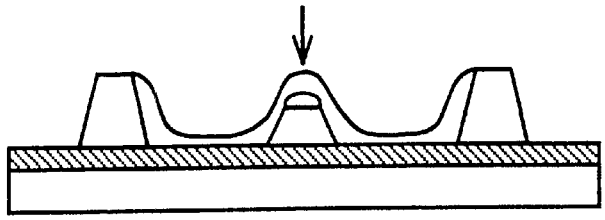

A manufacturing process of a back plate will be described according to steps shown in FIG. 29. A substrate 20 used here was a soda lime glass plate in a thickness of 2.8 mm. A light-reflection layer 17 was formed on the substrate 20 by screen-printing paste of light-reflective material, Prototype G3-2083 (A product of Okuno Chemical Industries Co., Ltd.), followed by drying (at 150° C.) and firing (at 550° C.) (the step (b)).

Then, a screen-printing was made in a height of the protrusion, first, by using a screen mask for both barrier ribs and protrusion. The printing was made during this process while the screen mask was shifted at regular intervals (e.g., 50 to 100 μm) to a direction opposite to a printing direction after every printing of single layer. The protrusion 23 and the barrier ribs 21 were formed by drying the paste (at 140° C.) every after printing of each layer, and firing it (at 550° C. for 60 min.) at once only after printing of all layers (the step (c)).

An address electrode 31 was formed on an upper part of the protrusion by screen-printing silver paste, XFP5392, followed by drying (at 140° C.), and firing (at 550° C.) (the step (d)).

Next, a white overcoating was formed by screen-printing paste, Prototype G3-2083 with a screen mask for protrusion, followed by drying (at 140° C.), and firing (at 550° C.) (the step (e)). Further, the barrier ribs were formed by screen-printing rib paste, G3-1961, to a predetermined height with a screen mask for barrier ribs only, followed by drying (at 140° C.), and firing (at 550° C.) (the step (f)).

Finally, a phosphor layer was formed between the barrier ribs constructed in the foregoing steps (the step (g)).

The PDP (panel A) was produced by arranging face to face the front plate and the back plate produced in the foregoing process, sealing a periphery of them with frit glass, and charging it with a mixture of Ne gas with 5% Xe, at a pressure of 500 torr after sufficient evacuation of air.

Another PDP (panel B), not provided with an overcoating, i.e. the phosphor layer is formed directly on the address electrode, was also produced in the same way as this exemplary embodiment. In addition, still another PDP (panel C) having a black-colored protrusion and a white-colored overcoating, and a PDP (panel D) having a white-colored protrusion and a black-colored overcoating were produced with the foregoing process.

An evaluation was conducted on the PDP's of four kinds (panels A through D) for brightness, luminous efficiency and operating life, by illuminating them in their entire screens, and causing an address discharge at regular intervals for displaying a predetermined pattern. The operating life was determined when a half-life period of brightness was reached, or if a failure occurred in the full-screen luminance. A result of the above evaluation is shown in Table5. The PDP, of which both the protrusion and the overcoating are of white color, has exhibited highest brightness and highest luminous efficiency as shown in Table 5.

TABLE 5

| | Brightness ($cd/m^2$) | Luminous efficiency (lm/W) | Operating life (h) |
|---|---|---|---|
| Panel A | 200 | 1.20 | 30000≦ |
| Panel B | 183 | 1.10 | 20000 |
| Panel C | 178 | 1.07 | 30000≦ |
| Panel D | 175 | 1.05 | 30000≦ |

With regard to the operating life, the PDP not provided with the overcoating has developed a disconnection due to adhesion of spattering substance that occurs during illumination, thereby resulting in a low reliability of the PDP.

As has been obvious from teachings of the seventeenth and eighteenth exemplary embodiments, the sloped surface can be formed at the end in the longitudinal direction of the protrusion by shifting the screen mask at regular intervals every time after printing each layer, when using screen printing as means of forming the protrusion 23. This makes it possible to form a highly reliable address electrode. Also, an ordinary printing method can be used without requiring any alteration for forming the address electrode including the sloped surface.

In the foregoing process, the reflection layer, the barrier ribs, the protrusion, the address electrode and the overcoating can be fired at the same time by selecting appropriate materials with consideration given to their softening points. Although printings were made while shifting the screen mask at regular intervals in forming the protrusion in the foregoing exemplary embodiments, the printings can be made while shifting the screen mask at intervals that increase gradually.

As has been described, the present invention is a plasma display panel, in which a protrusion lower than barrier ribs is formed on an inner surface of a back plate substrate, and a phosphor layer is formed on a rib surface in EU's including a surface of the protrusion. This can increase an effective area of the phosphor layer within the EU's so as to realize high brightness and high luminous efficiency.

Also, the invention for providing the address electrode on the upper part of the protrusion can realize an increase in height of the barrier ribs without necessitating a substantial change in space between the address electrode and a scan electrode. As a result, it allows the phosphor layer to be formed in a safer area with less degradation by an electric discharge, so as to realize a stable and speedy address-driving while reducing degradation of the phosphor layer.

In addition, the present invention can reduce a capacitance of a ineffectual capacitor not contributing to the discharge. Therefor, it can provide a highly efficient plasma display panel that can effectively reduce ineffectual power as well as a display device employing the same.

Further, the invention can provide a plasma display panel that can display white color of high color temperature, since it controls a balance of each color of the phosphor layers with shape of the respective protrusions.

Furthermore, the invention realizes formation of an address electrode, which extends from a substrate or a reflection layer toward an upper surface of a protrusion, without necessitating an alteration of the conventional forming method, thereby making it possible to form a highly reliable address electrode, since a structure of the protrusion includes a sloped surface formed at a end of it in the longitudinal direction.

What is claimed is:

1. A plasma display panel comprising:

a) a pair of display electrodes parallel to each other on one substrate; and b) a barrier rib, a phosphor layer and at least one electrode on another substrate, wherein a protrusion having a height smaller than said barrier rib is formed on at least one location within a unitary emission unit, said protrusion being on said another substrate and extending orthogonally to said pair of display electrodes.

2. The plasma display panel according to claim 1, wherein a plurality of said protrusions are oriented in two directions, protrusions extending in a direction generally parallel with said pair of display electrodes, and protrusions extending in a direction generally orthogonal to said pair of display electrodes.

3. The plasma display panel according to claim 1, wherein said phosphor layer covers directly or indirectly over a surface of said substrate, a surface of said protrusion, and a surface of said barrier rib.

4. The plasma display panel according to claim 1, wherein said electrode is formed directly or indirectly on an upper part of said protrusion.

5. The plasma display panel according to claim 4, wherein an overcoat layer is formed over said electrode.

6. The plasma display panel according to claim 5, wherein said phosphor layer is formed in a manner not to cover said electrode.

7. The plasma display panel according to claim 6, wherein a particular shape of said protrusion determines an intensity of individual luminescent color to control luminous balance of colors.

8. The plasma display panel according to claim 6, wherein at least one distal end in longitudinal direction of said protrusion forms a sloped surface.

9. The display panel according to claim 8, wherein an angle formed between said sloped surface and said substrate is at least 30 degrees.

10. The plasma display panel according to claim 8, wherein at least a top portion of said protrusion is white in color.

11. The plasma display panel according to claim 5, wherein a particular shape of said protrusion determines an intensity of individual luminescent color to control luminous balance of colors.

12. The plasma display panel according to claim 5, wherein at least one end in longitudinal direction of said protrusion forms a sloped surface.

13. The display panel according to claim 12, wherein an angle formed between said sloped surface and said substrate is at least 30 degrees.

14. The plasma display panel according to claim 12, wherein at least a top portion of said protrusion is white in color.

15. The plasma display panel according to claim 4, wherein at least one end in longitudinal direction of said protrusion forms a sloped surface.

16. The display panel according to claim 15, wherein an angle formed between said sloped surface and said substrate is at least 30 degrees.

17. The plasma display panel according to claim 15, wherein at least a top portion of said protrusion is white in color.

18. A plasma display panel comprising:

a) a barrier rib;

b) a phosphor layer;

c) at least one electrode and d) at least one protrusion in a height smaller than said barrier rib formed on at least one location within a unitary emission unit, all formed on one of substrates, wherein a shape of said protrusion particular to each of a plurality of colors determines an intensity of a respective luminescent color to control lumious balance of colors.

19. The plasma display panel according to claim 18, wherein a emission unit of individual luminescent color is provided with a protrusion having a particular shape corresponding to the individual luminescent color.

20. The plasma display panel according to claim 19, wherein a number of protrusions formed in a emission unit of blue color is greater than a number of protrusions formed in a emission unit of other color.

21. A plasma display panel comprising:

a substrate comprising an underlying layer;

at least two electrodes located in parallel with each other on an underlying layer, a protective layer, and a dielectric layer, wherein each of said at least two electrodes, said protective layer and said dielectric layer are located on a surface of the substrate, a portion of said surface is one of opened directly to a discharge space, open via only said protective layer to a discharge space, open via only said protective layer and said underlying layer to a discharge space, and open via only the underlying layer to a discharge space.

22. The plasma display panel according to claim 21, wherein said portion of the substrate surface has a shape of striped pattern.

23. The plasma display panel according to claim 21, wherein said portion of the substrate surface is a groove formed in said substrate.

24. The plasma display panel according to claim 23, wherein said groove is formed in a striped pattern.

25. The plasma display panel according to claim 23, wherein said groove is in parallel with said electrodes.

26. A plasma display device comprising:

a plasma display panel comprising:

a pair of display electrodes parallel with each other on one substrate; and a barrier rib, a phosphor layer and at least one electrode on another substrate, wherein a potrusion having a height smaller than said barrier rib is located within a unitary emission unit, said protrusion being on said another substrate and extending orthogonally to said pair of display electrodes, wherein said plasma display device is driven by AC voltage for displaying.

27. The plasma display device according to claim 26, wherein at least one of end surfaces in longitudinal direction of said protrusion is formed in sloped angle with respect to a surface of said substrate.

28. The plasma display device according to any of claim 26, wherein a particular shape of said protrusion determines an intensity of individual luminescent color to control luminous balance of colors.

29. A plasma display device employing a plasma display panel comprising:

a substrate comprising an underlying layer;

at least two electrodes formed in parallel with each other;

a protective layer, and a dielectric layer, wherein each of said at least two electrodes, said protective layer and said dielectric layer are located on a surface of the substrate, a portion of said surface is one of opened directly to a discharge space, open via only said protective layer to a discharge space, open via only said protective layer and an underlying layer to a discharge space, and open via only the underlying layer to a discharge space, and said plasma display device is driven by AC voltage for displaying.

30. The plasma display device according to claim 29, wherein a groove is formed on said substrate.

* * * * *

UNITED STATES PATENT AND TRADEMARK OFFICE

CERTIFICATE OF CORRECTION

PATENT NO. : 6,670,757 B2
DATED : December 30, 2003
INVENTOR(S) : Tetsuya Kato et al.

It is certified that error appears in the above-identified patent and that said Letters Patent is hereby corrected as shown below:

Title page,
Item [30], Foreign Application Priority Data, change the date of the fourth entry to -- July 22, 1998 --.
Item [56], References Cited, FOREIGN PATENT DOCUMENTS, delete "FR 2 762 426 4/1998".

Column 26,
Line 34, delete "any of".

Signed and Sealed this

First Day of June, 2004

JON W. DUDAS
*Acting Director of the United States Patent and Trademark Office*